US010135123B1

(12) United States Patent
Arnitz et al.

(10) Patent No.: US 10,135,123 B1
(45) Date of Patent: Nov. 20, 2018

(54) SYSTEMS AND METHODS FOR TUNABLE MEDIUM RECTENNAS

(71) Applicant: Searete LLC, Bellevue, WA (US)

(72) Inventors: Daniel Arnitz, Seattle, WA (US); Joseph Hagerty, Seattle, WA (US); Russell J. Hannigan, Sammamish, WA (US); Guy S. Lipworth, Seattle, WA (US); Matthew S. Reynolds, Seattle, WA (US); Yaroslav A. Urzhumov, Bellevue, WA (US)

(73) Assignee: Searete LLC, Bellevue, WA (US)

( * ) Notice: Subject to any disclaimer, the term of this patent is extended or adjusted under 35 U.S.C. 154(b) by 0 days.

(21) Appl. No.: 15/600,339

(22) Filed: May 19, 2017

(51) Int. Cl.

| | |
|---|---|
| ***H01Q 5/22*** | (2015.01) |
| ***H01Q 1/24*** | (2006.01) |
| ***H01Q 21/00*** | (2006.01) |
| *H01Q 1/36* | (2006.01) |

(52) U.S. Cl.
CPC ..... *H01Q 1/248* (2013.01); *H01Q 1/247* (2013.01); *H01Q 21/0025* (2013.01); *H01Q 1/364* (2013.01); *H01Q 5/22* (2015.01)

(58) Field of Classification Search
CPC ..... H01Q 1/24; H01Q 21/00; H01Q 5/22; H01Q 1/36
USPC ..... 343/751
See application file for complete search history.

(56) References Cited

U.S. PATENT DOCUMENTS 8,040,586 B2 10/2011 Smith
2010/0136926 A1 6/2010 Lackey
2010/0156573 A1* 6/2010 Smith ..... H01P 3/081 333/239
2011/0260920 A1 10/2011 Dybdal et al.
2012/0194399 A1* 8/2012 Bily ..... H01Q 13/28 343/772
2014/0056378 A1 2/2014 Harel et al.
(Continued)

OTHER PUBLICATIONS

Zhang et al.; "Optimal Load Analysis for a Two-Receiver Wireless Power Transfer System"; Wireless Power Transfer Conference (WPTC), 2014 IEEE 2014; pp. 84-87.
(Continued)

*Primary Examiner* — Andrea Lindgren Baltzell
(74) *Attorney, Agent, or Firm* — Phillips, Ryther & Winchester; Justin Flanagan

(57) ABSTRACT

An antenna system includes a tunable medium, rectifier circuitry, combining circuitry, and control circuitry. The tunable medium includes antenna elements corresponding to lumped impedance elements and variable impedance control inputs configured to enable selection of an impedance value for each of the lumped impedance elements. The control circuitry is configured to determine a scattering matrix (S-matrix) relating field amplitudes at lumped ports including internal lumped ports and lumped external ports. The internal lumped ports correspond to the lumped impedance elements, and the lumped external ports correspond to at least one of the rectifier circuitry inputs, the combined output of the combining circuitry, and the at least one transmitting element. A method includes determining at least a portion of component values of a desired S-matrix, and adjusting the variable impedance control inputs to at least approximate at least a portion of the desired S-matrix.

40 Claims, 7 Drawing Sheets

(56) References Cited

U.S. PATENT DOCUMENTS

2017/0356980 A1 12/2017 Islam et al.

OTHER PUBLICATIONS

Schurig et al., "Metamaterial Electromagnetic Cloak at Microwave Frequencies", Sciencexpress Report, Oct. 19, 2006, www.sciencexpress.org.

Hunt et al., "Metamaterial Apertures for Computational Imaging" with "Supplementary Materials for Metamaterial Apertures for Computational Imaging", Science, Jan. 18, 2013, vol. 339 www.sciencemag.org.

Smith et al., "Gradient Index Metamaterials", Physical Review E 71, The American Physical Society, Mar. 17, 2005.

Pendry et al., "Extremely Low Frequency Plasmons in Metallic Mesostructures", Physical Review Letters, Jun. 17, 1996, pp. 4773-4776, vol. 76, No. 25.

Shalaev, Vladimir M., "Optical Negative-Index Metamaterials", Nature Photonics, Jan. 2007, vol. 1, Nature Publishing Group.

Pendry et al., "Magnetism from Conductors and Enhanced Nonlinear Phenomena", IEEE Transactions on Microwave Theory and Techniques, Nov. 1999, vol. 47, No. 11.

Pendry et al, "Controlling Electromagnetic Fields", Science, Jun. 23, 2006, pp. 1780-1782, vol. 312, www.sciencemag.org.

Shelby et al., "Experimental Verification of a Negative Index of Refraction", Science, Apr. 6, 2001, pp. 77-79, vol. 292, www.sciencemag.org.

* cited by examiner

SYSTEMS AND METHODS FOR TUNABLE MEDIUM RECTENNAS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

PRIORITY APPLICATIONS

None

RELATED APPLICATIONS

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc., applications of the Priority Applications and the Related Applications, including any priority claims, is incorporated herein by reference to the extent such subject matter is not inconsistent herewith.

TECHNICAL FIELD

The present disclosure generally relates to rectennas. More specifically, this disclosure relates to systems and methods for tunable medium rectennas

DETAILED DESCRIPTION

Figure 1:
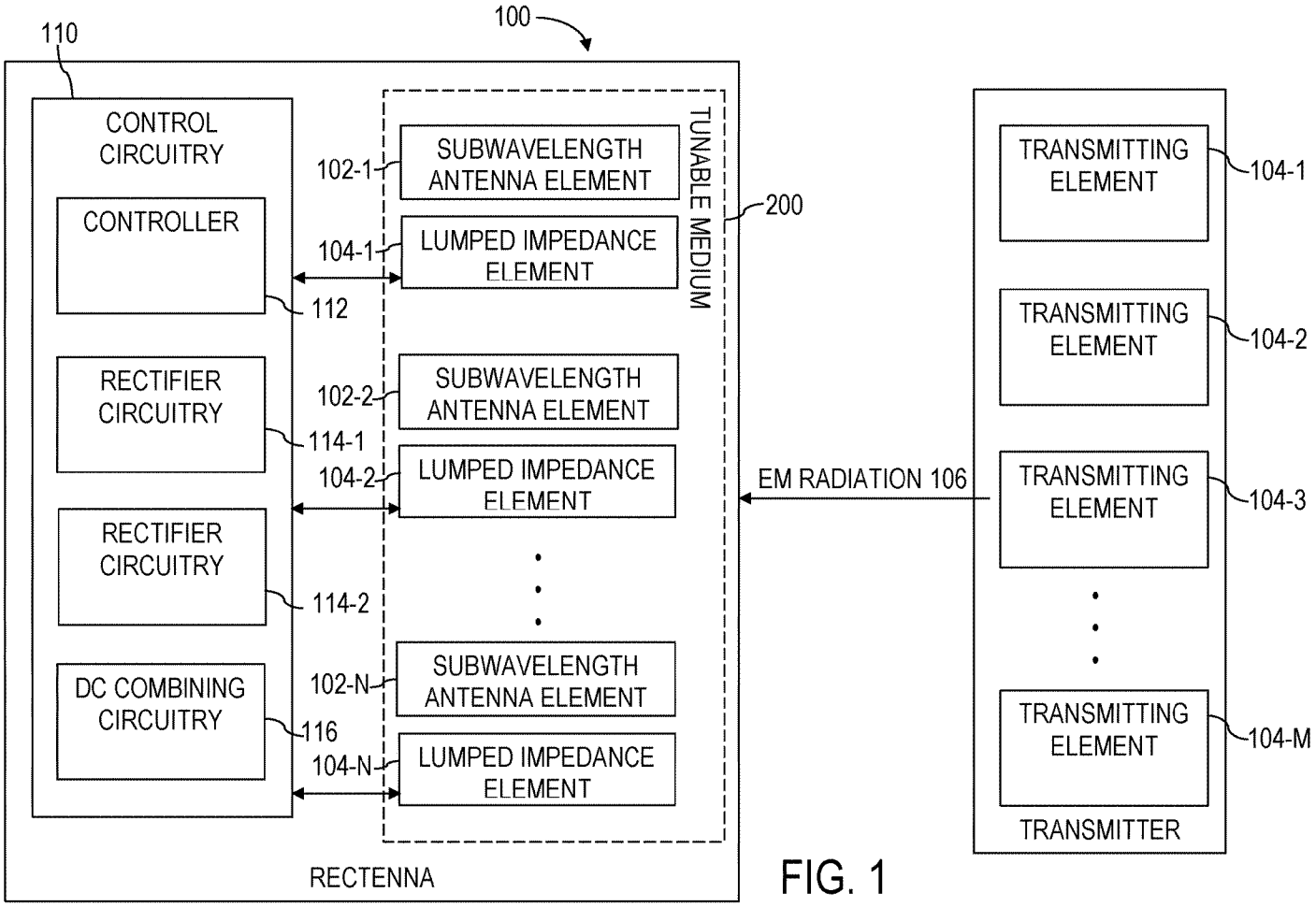
FIG. 1 is a simplified block diagram of an antenna system including a rectenna having a tunable medium.

The present disclosure provides various embodiments, systems, apparatuses, and methods that relate to antenna systems with tunable medium rectennas. Although the disclosure is generally described in terms of wireless power systems, the disclosure is not so limited. For example, embodiments of the disclosure also contemplate wireless communication systems, coherent power combining, coding (i.e., beamforming), and any other systems where tunable medium coding would be helpful or desirable.

Disclosed in some embodiments herein is a rectenna system including a tunable medium of receive elements, rectifier circuitry, and control circuitry. The tunable medium of receive elements is positioned relative to the rectifier circuitry. The tunable medium of receive elements receives electromagnetic (EM) radiation and transforms the EM radiation into RF signal(s), which are provided to the rectifier circuitry. The rectifier circuitry receives the RF signals and transforms the RF signal(s) into electrical current. Many embodiments of this disclosure pertain to distribution of electrical power via RF signals. Accordingly, the term "RF signal" is includes, but is not limited to modulated or information-carrying waveforms. For example, the term "RF signal" also includes continuous-wave (CW) radiation. The control circuitry includes a controller operably coupled to the tunable medium of receive elements. The controller is programmed to modify EM properties of the receive elements in the tunable medium to modify the EM radiation received from an EM transmitter to maximize the total current output of the rectifier circuitry and/or the conversion efficiency between the EM radiation and the electrical energy at the output of the rectifier circuitry.

A method of operating a rectenna may include operating a plurality of subwavelength EM receive elements in a tunable medium, operating a plurality of rectifier circuits, operating a combining circuit that combines outputs of at least one of the plurality of rectifier circuits into a combined output, determining a scattering matrix (S-matrix) relating field amplitudes at a plurality of lumped ports, N, wherein the plurality of lumped ports, N, include: internal lumped ports located internally to the tunable medium, each of the internal lumped ports corresponding to a different one of lumped impedance elements associated with a subwavelength EM receive element of the plurality of subwavelength EM receive elements, and lumped external ports located externally to the tunable medium, each of at least a portion of the lumped external ports corresponding to the at least one EM transmitting element and the combined output, wherein the S-matrix is expressible in terms of an impedance matrix, Z-matrix, with impedance values, $z_n$, of each of the plurality of lumped ports, N, determining an optimized port impedance vector $\{z_n\}$ of impedance values, $z_n$, for each of the internal lumped ports that result in an S-matrix element for the lumped external ports that maximizes the combined output at the combining circuit for a base frequency, determining at least a portion of component values of a desired S-matrix relating the field amplitudes at the lumped ports, adjusting at least one variable impedance control input configured to enable selection of an impedance value for each of the lumped impedance elements, wherein adjusting includes modifying the impedance value of at least one of the lumped impedance elements to cause the S-matrix to at least approximate at least a portion of the desired S-matrix, and scattering the EM radiation transmitted between the plurality of EM receive elements and the at least one EM transmitting element with the tunable medium.

In addition, disclosed herein is an antenna system that includes a plurality of antenna elements, a plurality of lumped impedance elements, a plurality of control inputs, a plurality of rectification circuits, a combining direct current (DC) circuit, and a computer-readable medium. Each of the plurality of antenna elements is spaced at subwavelength intervals with respect to other antenna elements based on an base frequency that is associated with a base harmonic frequency and at least one higher harmonic frequency. At least some of the plurality of lumped impedance elements are associated with the plurality of antenna elements. The plurality of control inputs is configured to allow for a selection of an impedance state for each of the plurality of lumped impedance elements. The impedance state refers to a set of frequency dependent impedance values. The plurality of rectification circuits is in communication with the plurality of antenna elements on a one to one, many to one, or one to many configuration. Each of the plurality of rectification circuits is configured to generate an output current from a radio frequency signal. The combining DC circuit is configured to combine at least one generated output current together into a combined output.

The computer-readable medium provides instructions that when executed by a processor cause the processor to: determine a scattering matrix (S-matrix) of electromagnetic field amplitudes at a select frequency and at the at least one higher harmonic frequency, for each of a plurality of lumped ports, N, where the plurality of lumped ports, N, include: a plurality of lumped antenna ports, $N_a$, with impedance values corresponding to the impedance state for each of the plurality of lumped impedance elements at each of the corresponding frequencies, and at least one lumped external port, $N_e$, located physically external to the antenna system, where the S-matrix is expressible in terms of an impedance matrix, Z-matrix, with impedance values, $z_n$, of each of the plurality of lumped ports, N, at each of the corresponding frequencies, determine an optimized port impedance vector $\{z_n\}$ of impedance values, $z_n$, for each of the tunable impedance elements represented by lumped ports, $N_a$, that result in an S-matrix element for the at least one lumped external port, $N_e$, that maximizes the combined output at the combining DC circuit for the base frequency, and adjust at least one of the plurality of control inputs to modify at least one of the plurality of lumped impedance elements based on the determined optimized $\{z_n\}$ of the impedance values for the tunable impedance elements represented by lumped ports, $N_a$.

The base frequency may be a center frequency of an essentially or substantially continuous wave, a center frequency of a narrow-band modulated signal, or correspond to a peak spectral power density of a modulated signal. The select frequency at which the scattering matrix is determined may be associated with the base frequency and/or one other frequency, such as a harmonic frequency. Examples of suitable frequencies for selecting the "select frequency" include the base frequency itself or a function of the base frequency and an integer harmonic or rational harmonic frequency.

A rectifying antenna or rectenna converts electromagnetic (EM) energy (also referred to herein as radio frequency (RF) energy) into direct current (DC) electricity. In various embodiments, the rectennas may be adapted to collection as much electrical energy as possible, without regard to the sensitivity levels that might normally be associated with information transfer.

From the RF wave propagation perspective a rectenna can be viewed as having two parts: an RF part and a DC part. The RF part receives RF waves and ensures that they are sent to the rectification subcircuits as efficiently as possible. In some embodiments, efficiency is defined as conversion efficiency. The RF part and the DC part interact with each other through nonlinear elements, such as diodes or transistors. Consequently, tuning of any element in the DC part may cause a significant change in the behavior of the RF part.

Traditional rectennas often include multiple rectification sites (e.g., rectification subcircuits) and multiple antenna sites (e.g., antenna elements). However, in traditional rectennas, the antennas (e.g., RF part) are either isolated or almost isolated with respect to each other. This isolation results in a modular structure (e.g., with one antenna and one rectification subcircuit forming a module). In such a configuration, each module performs reception and conversion essentially independently from all the other modules. Since each module has a single DC current output port, the DC currents of the numerous ports may be combined in one way or another (using traditional techniques, for example).

It is appreciated that the isolation or near isolation of the antennas in traditional antennas is largely due to antenna spacing. As the spacing between antenna elements decreases into subwavelength territory (e.g., less than one-half wavelength or less than one-quarter wavelength) the antenna elements start to mutually couple with each other and are no longer isolated with respect to each other. This deeply subwavelength antenna spacing structure is or can be referred to as a metamaterial rectenna (also referred to herein as a tunable medium rectenna). Because of the mutual coupling between the antenna elements in a metamaterial rectenna, it is no longer possible to individually control the amplitude and phase of the RF signal being sent to the rectification subcircuit(s). Thus, the modular approach of individual optimization of each module is no longer feasible.

The systems and methods described herein relate to the optimization of the metamaterial rectenna as a whole (e.g., multiple antenna elements optimized with multiple rectification elements). For example, the RF part of the metamaterial rectenna is optimized to maximize conversion efficiency between the incident RF signal and the resulting output current. In some embodiments, the metamaterial rectenna may viewed from the RF perspective as having multiple RF receive elements; multiple modulating elements, which are controlled by these lumped impedance elements; and multiple RF output ports that feed the RF signal to the rectification circuits.

Transmission between the RF output ports and the rectification circuits is not one-way. Instead, it is an interactive interchange with the rectification circuits both receiving RF power and sending some of that radiation back. For example, rectification circuits may reject some of the radiation, such as higher harmonics.

It is appreciated that metamaterial rectennas have numerous RF output ports that feed into numerous rectification subcircuits. Since the primary function of a rectenna is to produce DC power from RF, the goal is now not to maximize the total RF output from a signal port but rather to maximize the DC current output and/or maximize the overall conversion efficiency given a certain incident RF wave.

As noted above, the metamaterial rectenna has two parts: the RF part that includes a number of lumped impedance elements that are tunable and the rectification subcircuits that include a number of DC outputs. Because these rectification circuits impact the RF part, depending on what the rectification circuits do, they may modify the receive aperture efficiency of the RF portion of the structure. Accordingly, there is an optimal power flux that the rectification circuit can handle most efficiently. In other words, if rectification circuits are overloaded, the overloaded power will be rejected (e.g., reflected back).

The already complex problem of balancing all of the RF loads of a rectenna system is exacerbated due to the mutual coupling of the different receive antenna elements. The power directed to the rectification circuits may be reflected from there, but may be received by a nearby, reactively coupled antenna element. Due to the mutual coupling which gives rise to complex interactions between antenna elements, the systems and methods described herein provide for optimization of the structure or system as a whole. For example, the system may be optimized as a whole to maximize DC current output and/or maximize conversion efficiency. The present systems and methods describe how this optimization is performed.

As used herein, the terms "EM receiving element" and "EM receiving elements" or "subwavelength antenna element" and "subwavelength antenna elements" refer to structures that controllably receive EM radiation. For example, EM receiving elements may include dipole antennas, at least substantially omnidirectional antennas, patch antennas, aperture antennas, antenna arrays (e.g., multiple antennas functioning in an array to act together as a single EM receiving element, multiple antennas functioning in an array to act as multiple EM receiving elements, etc.), other EM receiving elements, or combinations thereof. As used herein, the term "at least substantially omnidirectional" refers to antennas having far-field directivity patterns that are approximately circular (e.g., in a horizontal plane) or spherical (e.g., for three-dimensional antenna patterns). By way of non-limiting example, a dipole antenna may be considered an omnidirectional antenna because a radiation pattern in a plane perpendicular to the dipole antenna is approximately circular. As will be appreciated by those of ordinary skill in the art, truly three-dimensional omnidirectional antennas are difficult or impossible to implement in practice at least because a feed point for enabling EM input to the antenna will disrupt a perfect spherical directivity pattern. The term "at least substantially omnidirectional" accounts for this practicality and the lack of such a qualifier can be implied, as contextually appreciated by one of skill in the art.

As used herein, the term "beamforming" refers to selectively (e.g., controllably) increasing signal power at one or more locations (e.g., locations of receiving antennas), decreasing signal power at one or more other locations (e.g., locations where there are no receiving antennas), or combinations thereof.

As used herein, the term "near-end" refers to equipment located at a particular location (i.e., a near-end location). As used herein, the term "far-end" refers to locations located remotely from the particular location. Accordingly, the terms "near-end" and "far-end" are relative terms depending on the location of the particular location. For example, a first plurality of electromagnetic radiating elements would be a plurality of near-end electromagnetic radiating elements if located at the particular location. Also, a second plurality of electromagnetic radiating elements would be a plurality of far-end electromagnetic radiating elements if located remotely from the particular location (and, by extension, remotely from the first plurality of electromagnetic radiating elements). Conversely, if the particular location were instead deemed to be at the same location as the second plurality of electromagnetic radiating elements, the first plurality of electromagnetic radiating elements would be a plurality of far-end electromagnetic radiating elements. Also, the second plurality of electromagnetic radiating elements would be a plurality of near-end electromagnetic radiating elements if the particular location were deemed to be at the same location as the second plurality of electromagnetic radiating elements.

Various features disclosed herein may be applied alone or in combination with others of the features disclosed herein. These features are too numerous to explicitly indicate herein each and every other one of the features that may be combined therewith. Therefore, any feature disclosed herein that is practicable, in the view of one of ordinary skill, to combine with any other one or more others of the features disclosed herein, is contemplated herein to be combined. A non-exhaustive list of some of these disclosed features that may be combined with others of the disclosed features follows.

For example, in some embodiments, disclosed is an antenna system including a plurality of antenna elements (e.g., near-end/receive EM radiating elements), a plurality of lumped impedance elements, a plurality of impedance control inputs, a plurality of rectification circuits, a combining DC circuit, and a computer-readable medium. Each of the plurality of antenna elements is spaced at subwavelength intervals relative to a base frequency. At least a portion of the plurality of lumped impedance elements is associated with the plurality of antenna elements. Each of the plurality of impedance control inputs is configured to allow for a selection of an impedance value for each of the plurality of lumped impedance elements. Each of the plurality of rectification circuits is in communication with one or more of the plurality of antenna elements. Each of the plurality of rectification circuits is configured to generate an output current based on received RF power. The combining DC circuit combines (controllably combines, for example) one or more generated output currents together into a combined output. The computer-readable medium provides instructions that when executed by a processor cause the processor to determine a scattering matrix (S-matrix) of electromagnetic field amplitudes for each of a plurality of lumped ports, N. The plurality of lumped ports, N, include a plurality of lumped antenna ports, $N_a$, with impedance values corresponding to the impedance values for each of the plurality of lumped impedance elements, and at least one lumped external port, $N_e$, located physically external to the antenna system. The S-matrix is expressible in terms of an impedance matrix, Z-matrix, with impedance values, $z_n$, of each of the plurality of lumped ports, N.

The computer-readable medium may also provide instructions that when executed by the processor cause the processor to determine an optimized port impedance vector $\{z_n\}$ of impedance values, $z_n$, for each of the tunable impedance elements represented by lumped ports, $N_a$, that result in an S-matrix element for the at least one lumped external port, $N_e$, that maximizes the combined output at the combining DC circuit for the base frequency, and adjust at least one of the plurality of impedance control inputs to modify at least one of the plurality of lumped impedance elements based on the determined optimized $\{z_n\}$ of the impedance values for tunable impedance elements represented by lumped ports, $N_a$.

In some embodiments, an antenna system may include a plurality of antenna elements coupled to the plurality of rectification circuits via a direct electrical connection. In some embodiments, an antenna system may include a plurality of antenna elements coupled to the plurality of rectification circuits via evanescent coupling. In some embodiments, an antenna system may include a plurality of antenna elements coupled to the plurality of rectification circuits in a one-to-one arrangement.

In some embodiments, an antenna system may include a plurality of antenna elements coupled to the plurality of rectification circuits in a plurality-to-one arrangement. In some embodiments, an antenna system may include a plurality of antenna elements in a first layer and a plurality of rectification in a second layer that is different from the first layer. The layers may be planar or curved and may or may not be parallel to one another.

In some embodiments, an antenna system may include a plurality of antenna elements and the plurality of rectification circuits in an integrated or embedded first layer. In some embodiments, an antenna system may include a plurality of rectification circuits geometrically located between the plurality of antenna elements.

In some embodiments, an antenna system may include a plurality of antenna elements at least partially overlapping with the plurality of rectification circuits. In some embodiments, an antenna system may include a combining DC circuit to combine the one or more generated output currents together into the combined output by, for example, summing over the one or more generated output currents. In some embodiments, an antenna system may include a combining DC circuit to combine each of the generated current outputs into the combined output.

In some embodiments, the base frequency may be associated with a base harmonic frequency and at least one higher harmonic frequency. In some embodiments, an antenna system may include integrated instructions (e.g., as software, firmware, and/or hardware) to determine a scattering matrix (S-matrix) of electromagnetic field amplitudes for each of a plurality of lumped ports, N, may include instructions that when executed by the processor cause the processor to determine an S-matrix at the base harmonic frequency and at each of the at least one higher harmonic frequency.

In some embodiments, the instructions to determine an optimized port impedance vector $\{z_n\}$ of impedance values, $z_n$, for each of the lumped antenna ports, $N_a$, that result in an S-matrix element for the at least one lumped external port, $N_e$, that maximizes the combined output current at the combining DC circuit for the base frequency, may include instructions that when executed by the processor cause the processor to determine an optimized port impedance vector $\{z_n\}$ of impedance values, $z_n$, for each of the lumped antenna ports, $N_a$, that result in an S-matrix element for the at least one lumped external port, $N_e$, that maximizes the combined output current at the combining DC circuit for the base harmonic frequency and that maximizes the combined output current at the combining DC circuit for each of the at least one higher base frequency.

In some embodiments, at least one of the plurality of impedance control inputs may be adjusted to maximize a conversion efficiency between a radio frequency signal and the combined output. In some embodiments, at least one of the plurality of impedance control inputs may be adjusted to maximize a total output current at the combined output.

In some embodiments, each rectification circuit may include one or more rectifier tunable elements. In some embodiments, the antenna system may further include a plurality of rectification control inputs configured to allow for tuning of each of the one or more rectifier tunable elements. In some embodiments, at least one of the one or more rectifier tunable elements may modify a resistance of a respective rectification circuit. In some embodiments, each rectifier tunable element may be selected from any of a variable resistor, a variable capacitor, a variable inductor, a transistor, a varactor diode, and a voltage-controlled non-linear element.

In some embodiments, the instructions may be further executable by the processor to adjust at least one of the plurality of rectifier control inputs together with the adjusting the at least one of the plurality of impedance control inputs to balance the impedance value for each of one or more lumped impedance elements with a resistance value of the rectification circuit. In some embodiments, at least one of the one or more rectifier tunable elements may modify a phase of a received radio frequency signal at a respective rectification circuit.

In some embodiments, each rectifier tunable element may be selected from any of a transistor, a varactor diode, a phase shifter, and a voltage-controlled non-linear element. In some embodiments, at least one of the one or more rectifier tunable elements may attenuate a received radio frequency signal at a respective rectification circuit. In some embodiments, each rectifier tunable element may be selected from any of a variable resistor, a transistor, an attenuator, a voltage-controlled non-linear element, and a varactor diode. In some embodiments, the instructions may further be executable by the processor to adjust at least one of the plurality of rectifier control inputs together with the adjusting the at least one of the plurality of impedance control inputs to maximize the combined output.

In some embodiments, the instructions may further be executable by the processor to adjust at least one of the plurality of rectifier control inputs together with the adjusting the at least one of the plurality of impedance control inputs to maximize a conversion efficiency between a radio frequency signal and the combined output. In some embodiments, the combining DC circuit may include one or more DC tuning elements. In some embodiments, the antenna system may further include one or more DC tuning control inputs configured to allow for tuning of each of the one or more DC tuning elements.

In some embodiments, at least one of the one or more DC tuning elements may modify a resistance of the combining DC circuit. In some embodiments, each DC tuning element may be selected from any of a variable resistor, a transistor, a voltage-controlled non-linear resistance element, a Schottky diode, and a varactor diode.

In some embodiments, the instructions may further be executable by the processor to adjust at least one of the one or more DC tuning control inputs together with the adjusting the at least one of the plurality of rectifier tunable control inputs and the adjusting the at least one of the plurality of impedance control inputs to maximize the combined output. In some embodiments, the instructions may further be executable by the processor to adjust at least one of the one or more DC tuning control inputs together with the adjusting the at least one of the plurality of rectifier tunable control inputs and the adjusting the at least one of the plurality of impedance control inputs to maximize a conversion efficiency between a radio frequency signal and the combined output.

In some embodiments, the subwavelength interval may be less than one-half of a wavelength of a smallest frequency in a base frequency range. In some embodiments, the subwavelength interval may be less than one-quarter of a wavelength of a smallest frequency in a base frequency range. In some embodiments, each antenna element may be a subwavelength antenna element, where subwavelength is less than a wavelength of a smallest frequency in a base frequency range. In some embodiments, at least some of the plurality of antenna elements include resonating elements.

In some embodiments, at least two of the plurality of antenna elements may be included in a metamaterial. In some embodiments, the at least one lumped external port, $N_e$, may be a virtual external port. In some embodiments, the at least one lumped external port, $N_e$, may be a transmitting antenna associated with an external device. In some embodiments, each of the plurality of lumped impedance elements may be associated with a unique impedance control input, such that the impedance value of each lumped impedance element is independently variable. In some embodiments, a variable impedance control input associated with at least one of the lumped impedance elements may include a direct current (DC) voltage input, where the impedance value of the at least one lumped impedance element is based on a magnitude of a voltage supplied via the DC voltage input.

In some embodiments, a variable impedance control input associated with at least one of the lumped impedance elements may be varied to adjust the impedance value of the at least one lumped impedance element, where the variable impedance control input includes one of: an electrical current input, a radiofrequency electromagnetic wave input, an optical radiation input, a thermal radiation input, a terahertz radiation input, an acoustic wave input, a phonon wave input, a thermal conduction input, a mechanical pressure input and a mechanical contact input.

In some embodiments, the impedance value of at least one of the lumped impedance elements may be variable based on one or more electrical impedance control inputs. In some embodiments, the impedance value of at least one of the lumped impedance elements may be variable based on one or more mechanical impedance control inputs.

A method of operating a rectenna may include operating a plurality of subwavelength electromagnetic (EM) receive elements in a tunable medium, operating a plurality of rectifier circuits, operating a combining circuit that combines outputs of at least one of the plurality of rectifier circuits into a combined output, determining a scattering matrix (S-matrix) relating field amplitudes at a plurality of lumped ports, N. The plurality of lumped ports, N, may include: internal lumped ports located internally to the tunable medium, each of the internal lumped ports corresponding to a different one of lumped impedance elements associated with a subwavelength EM receive element of the plurality of subwavelength EM receive elements, and lumped external ports located externally to the tunable medium, each of at least a portion of the lumped external ports corresponding to the at least one EM transmitting element and the combined output.

The S-matrix is expressible in terms of an impedance matrix, Z-matrix, with impedance values, $z_n$, of each of the plurality of lumped ports, N, determining an optimized port impedance vector $\{z_n\}$ of impedance values, $z_n$, for each of the internal lumped ports that result in an S-matrix element for the lumped external ports that maximizes the combined output at the combining circuit for a selected frequency (corresponding to the base frequency), determining at least a portion of component values of a desired S-matrix relating the field amplitudes at the lumped ports, adjusting at least one variable impedance control input configured to enable selection of an impedance value for each of the lumped impedance elements, wherein adjusting includes modifying the impedance value of at least one of the lumped impedance elements to cause the S-matrix to modify to at least approximate at least a portion of the desired S-matrix, and scattering the EM radiation transmitted between the plurality of EM receive elements and the at least one EM transmitting element with the tunable medium.

In some embodiments, the plurality of EM receive elements may be coupled to the plurality of rectification circuits via a direct electrical connection. In some embodiments, the plurality of EM receive elements may be coupled to the plurality of rectification circuits via evanescent coupling. In some embodiments, the plurality of EM receive elements may be coupled to the plurality of rectification circuits in a one-to-one arrangement.

In some embodiments, the plurality of EM receive elements may be coupled to the plurality of rectification circuits in a plurality-to-one arrangement. In some embodiments, the combining circuit may combine one or more output currents from the plurality of rectifier circuits together into the combined output by summing over the one or more output currents. In some embodiments, the base frequency may be associated with a base harmonic frequency and at least one higher harmonic frequency.

In some embodiments, determining a scattering matrix (S-matrix) relating field amplitudes at a plurality of lumped ports, N, may include determining an S-matrix at the base harmonic frequency and at each of the at least one higher harmonic frequency. In some embodiments, determining an optimized port impedance vector $\{z_n\}$ of impedance values, $z_n$, for each of the internal lumped ports that result in an S-matrix element for the lumped external ports that maximizes the combined output at the combining circuit for a selected frequency may include determining an optimized port impedance vector $\{z_n\}$ of impedance values, $z_n$, for each of the internal lumped ports that result in an S-matrix element for the lumped external ports that maximizes the combined output at the combining circuit for the base harmonic frequency and that maximizes the combined output at the combining circuit for each of the at least one higher harmonic frequency.

In some embodiments, each rectifier circuit may include one or more variable resistance control inputs for tuning the rectifier circuit.

In some embodiments, the method may further include adjusting at least one variable resistance control input together with the adjusting the at least one variable impedance control input to maximize the combined output at the combining circuit.

In some embodiments, the combining circuit may include one or more variable resistance tuning inputs for tuning the combining circuit. In some embodiments, the method that may further include adjusting at least one variable resistance tunable input together with the adjusting the at least one variable resistance control input and the adjusting the at least one variable impedance control input to maximize the combined output at the combining circuit.

In some embodiments, a size of the subwavelength EM receive element may be less than one-half of a wavelength of a smallest frequency in a base frequency range. In some embodiments, a size of the subwavelength EM receive element may be less than one-quarter of a wavelength of a smallest frequency in a base frequency range.

An antenna system may include a plurality of antenna elements, a plurality of lumped impedance elements, a plurality of control inputs, a plurality of rectification circuits, a combining DC circuit, and a computer-readable medium. Each of the plurality of antenna elements may be spaced at subwavelength intervals relative to a base frequency that is associated with a base harmonic frequency and at least one higher harmonic frequency. At least a portion of the plurality of lumped impedance elements is associated with the plurality of antenna elements. Each of the plurality of control inputs may be configured to allow for a selection of an impedance state for each of the plurality of lumped impedance elements. As used herein, the impedance state refers to a set of frequency dependent impedance values. The plurality of rectification circuits may each (or collectively) be in communication with the plurality of antenna elements. Each of the plurality of rectification circuits may generate an output current based on a received RF signal. The combining DC circuit is for combining at least one generated output current together into a combined output.

In some embodiments, the computer-readable medium provides instructions that, when executed by a processor, cause the processor to: determine a scattering matrix (S-matrix) of electromagnetic field amplitudes at a select frequency and at the at least one higher harmonic frequency, for each of a plurality of lumped ports, N, where the plurality of lumped ports, N, include: a plurality of lumped antenna ports, $N_a$, with impedance values corresponding to the impedance state for each of the plurality of lumped impedance elements at each of the corresponding frequencies, and at least one lumped external port, $N_e$, located physically external to the antenna system, where the S-matrix is expressible in terms of an impedance matrix, Z-matrix, with impedance values, $z_n$, of each of the plurality of lumped ports, N, at each of the corresponding frequencies, determine an optimized port impedance vector $\{z_n\}$ of impedance values, $z_n$, for each of the lumped antenna ports, $N_a$, that result in an S-matrix element for the at least one lumped external port, $N_e$, that maximizes the combined output at the combining DC circuit for to selected frequency, and adjust at least one of the plurality of control inputs to modify at least one of the plurality of lumped impedance elements based on the determined optimized $\{z_n\}$ of the impedance values for the lumped antenna ports, $N_a$.

In some embodiments, the plurality of antenna elements may be coupled to the plurality of rectification circuits via a direct electrical connection. In some embodiments, each of the plurality of antenna elements is coupled to the plurality of rectification circuits via evanescent coupling. In some embodiments, each of the plurality of antenna elements may be coupled to one or more of the plurality of rectification circuits in a one-to-one arrangement.

In some embodiments, the plurality of antenna elements may be coupled to the plurality of rectification circuits in a plurality-to-one arrangement. In some embodiments, the plurality of antenna elements may be in a first layer and the plurality of rectification circuits may be in a second layer that is different from the first layer.

In some embodiments, the plurality of antenna elements may be in a first layer and the plurality of rectification circuits may be embedded in the first layer. In some embodiments, the plurality of rectification circuits may be geometrically located between the plurality of antenna elements. In some embodiments, the plurality of antenna elements may be at least partially overlapping with the plurality of rectification circuits.

In some embodiments, the combining DC circuit may combine the one or more generated output currents together into the combined output by summing over the one or more generated output currents. In some embodiments, the combining DC circuit may combine each of the generated current outputs into the combined output.

Examples of components and devices that may be associated with system using the teaching described herein include, but are not limited to, battery charging stations, cells within a battery, a rectifying circuit, personal electronic devices, cell phones, laptops, tablets, transformer circuits, frequency converter circuits, multiplier circuits, components of motor/electric/hybrid/fuel-cell vehicles, remotely operated vehicles, medical implants, and/or a medical device temporarily or permanently residing within a patient.

Many existing computing devices and infrastructures may be used in combination with the presently described systems and methods. Some of the infrastructure that can be used with embodiments disclosed herein is already available, such as general-purpose computers, computer programming tools and techniques, digital storage media, and communication links. A computing device or controller may include a processor, such as a microprocessor, a microcontroller, logic circuitry, or the like.

A processor may include a special-purpose processing device, such as application-specific integrated circuits (ASIC), programmable array logic (PAL), programmable logic array (PLA), programmable logic device (PLD), field programmable gate array (FPGA), or other customizable and/or programmable device. The computing device may also include a machine-readable storage device, such as non-volatile memory, static RAM, dynamic RAM, ROM, CD-ROM, disk, tape, magnetic, optical, flash memory, or other machine-readable storage medium. Various aspects of certain embodiments may be implemented using hardware, software, firmware, or a combination thereof.

For some of the embodiments, reference is made to the accompanying drawings, which form a part of this disclosure. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein.

The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In many instances, well-known structures, materials, or operations are not shown or described in detail to avoid obscuring aspects of this disclosure.

FIG. 1 is a simplified block diagram of an antenna system 100 including a rectenna having a tunable medium 200. The tunable medium 200 includes a plurality of subwavelength antenna elements (e.g., near-end EM radiating elements) 102-1, 102-2, . . . 102-N (sometimes referred to herein generally together as "subwavelength antenna elements" 102, and individually as "subwavelength antenna element" 102) and a plurality of lumped impedance elements 104-1, 104-2, . . . 104-N (sometimes referred to herein generally together as "lumped impedance elements" 104, and individually as "lumped impedance element" 104).

The lumped impedance elements 104 may define EM properties associated with the subwavelength antenna elements 102. In some embodiments, the lumped impedance elements 104 are tunable (e.g., controllable). In one example, there may be a one-to-one (1:1) mapping between the subwavelength antenna elements 102 and the lumped impedance elements 104. In another example, there may be a many-to-one or one-to-many mapping between the subwavelength antenna elements 102 and the lumped impedance elements 104. Although not shown, a lumped impedance element 104 may be coupled to a subwavelength antenna element 102.

In one example, the plurality of subwavelength antenna elements 102 may be located at a near-end location and at least one transmitting element (e.g., far-end EM radiating element) 104-1, 104-2, 104-3, . . . 104-M (sometimes referred to herein generally together as "transmitting elements" or "transmitting EM radiating elements" 104, and individually as "transmitting element" or transmitting EM radiating element" 104) may be located at one or more far-end locations.

The rectenna of the antenna system 100 also includes control circuitry 110 operably coupled to the tunable medium 200. The control circuitry 110 includes a controller 112 programmed to modify EM properties of the subwavelength antenna elements 102 to modify the way EM radiation 106 (from the transmitting elements 104, for example) is received by the subwavelength antenna elements 102. In some embodiments, the controller 112 is operably coupled to the lumped impedance elements 104. The controller 112 may tune one or more lumped impedance elements 104 to change the EM behavior of one or more subwavelength antenna elements 102. In some cases, at least a portion of the lumped impedance elements 104 may be tuned to change the EM properties of the rectenna (e.g., some of the subwavelength antenna elements 102 may function as reflectors instead of radiators, for example).

In some embodiments, the controller 112 is programmed to dynamically (e.g., on the order of a fraction of minutes and/or on the order of a fraction of seconds) modify the EM properties of the subwavelength antenna elements 102 to dynamically modify the way EM radiation is received by the subwavelength antenna elements 102. In some embodiments, the controller 112 is programmed to pre-select a state of the tunable medium 200 (e.g., a state of the subwavelength antenna elements 102) and hold the tunable medium 200 in the pre-selected state during operation of the antenna system 100. Regardless of whether the controller 112 is programmed to dynamically modify or pre-select the EM properties of the tunable medium 200, the tunable medium 200 may function as a coherent power combiner (e.g., linear decoder). For example, the subwavelength antenna elements 102 may function as a coherent power combiner.

The controller 112 may be programmed to control the tunable medium 200. For example, the controller 112 may be programmed to control the tunable medium 200 to function as a linear coherent power combiner, a linear beamforming decoder, a linear spatial-diversity decoder, a linear spatial multiplexing decoder, or combinations thereof.

The control circuitry 110 may also include rectifier circuitry 114 operably coupled to the subwavelength antenna elements 102. The rectifier circuitry 114 is configured to convert EM signals (e.g., RF signals) into a DC output current (not shown).

The control circuitry 110 may further include DC combining circuitry 116 operably coupled to the rectifier circuitry 114. The DC combining circuitry 116 is configured to receive generated current outputs from one or more or the rectifier circuitry 114 and to provide a combined DC current output.

The disclosure contemplates various arrangements of the subwavelength antenna elements 102 and the transmitting elements 104 (e.g., transmitting EM radiating elements). By way of non-limiting example, the transmitting EM radiating elements 104 may be distributed among at least two physically separate devices (e.g., a plurality of charging devices and one transmitting EM radiating element 104 per device, more than one transmitting EM radiating element 104 per device, or combinations thereof). Also by way of non-limiting example, the transmitting EM radiating elements 104 may all be included in the same physical device. Similarly, the subwavelength antenna elements 102 may all be included in the same physical device (with one or more tunable media 200).

Figure 2:
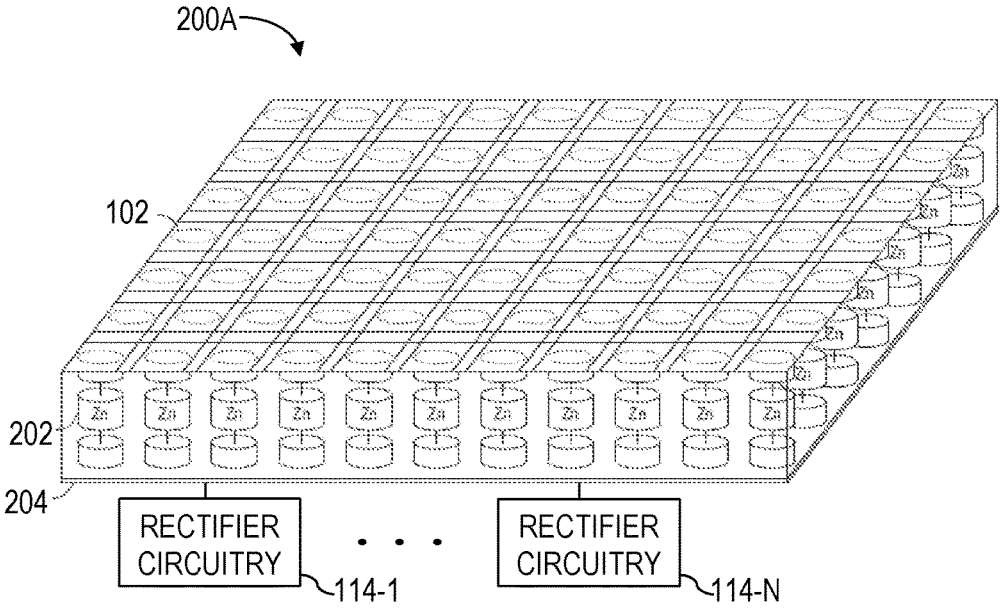
FIG. 2 illustrates a conceptual model of a tunable medium showing a section of an array of subwavelength antenna elements.

FIG. 2 illustrates a conceptual model of a tunable medium 200A showing a section of an array of subwavelength antenna elements 102 with associated variable lumped impedance elements, $z_n$, 202, according to a simplified embodiment. As previously described, the subwavelength antenna elements 102 may have inter-element spacings that are substantially less than a free-space wavelength corresponding to a base frequency or frequency range of the tunable medium 200A. For example, the inter-element spacings may be less than one-half or less than one-quarter of the free-space operating wavelength.

As shown, each of the subwavelength antenna elements 102 is associated with at least one lumped impedance element 202. An interface 204 may enable coupling between the subwavelength antenna elements 102 (via the lumped impedance elements 202, for example) and rectifier circuitry 114. In one example, subwavelength antenna elements 102 may be coupled to rectifier circuitry 114 in a 1:1 ratio. In other examples, subwavelength antenna elements 102 may be coupled to rectifier circuitry 114 in a many-to-one (e.g., M:1) or many-to-many (e.g., M:N) ratio. In one example, the interface 204 may provide direct wiring connection between one or more rectifier circuitry 114 and one or more subwavelength antenna elements 102. In another example, the interface 204 may enable evanescent coupling (e.g., wireless coupling) between one or more rectifier circuitry 114 and one or more subwavelength antenna elements 102.

Each lumped impedance element 202 may have a variable impedance value that is set during manufacture or that can be dynamically tuned via one or more control inputs. The 1:1 ratio of lumped impedance elements 202 and subwavelength antenna elements 102 is merely exemplary and other ratios are possible.

In some embodiments, the subwavelength antenna elements 102 may be divided into two or more groups that are separated from one another by no more than one-half of an operating wavelength. Each group of subwavelength antenna elements 102 may be spatially separated from each other group of subwavelength antenna elements 102 by at least a distance exceeding that of one-half of an operating wavelength.

The separation of each group of subwavelength antenna elements 102 from each other may be greater than a Fraunhofer (far-field) distance associated with an aperture diameter of a largest of the at least two groups. In other embodiments, the separation from each group may be less than a Fraunhofer distance. In other embodiments, the separation of each group may be shorter than a diameter of a largest of the at least two groups or alternatively the separation distance may be associated with the free-space operation wavelength (e.g., longer, the same as, or shorter). In many embodiments, the individual elements and/or groups of elements may be in the reactive near-field of one another. The groups of subwavelength antenna elements 102 may be part of a receiver antenna element physically coupled to a receiver device.

The array of subwavelength antenna elements 102 in the tunable medium 200A need not be planar as illustrated in FIG. 2, though it may be. In some embodiments, two groups of subwavelength antenna elements 102 are coplanar with one another and at least one other group is non-co-planar with the first two, co-planar groups.

Figure 3:
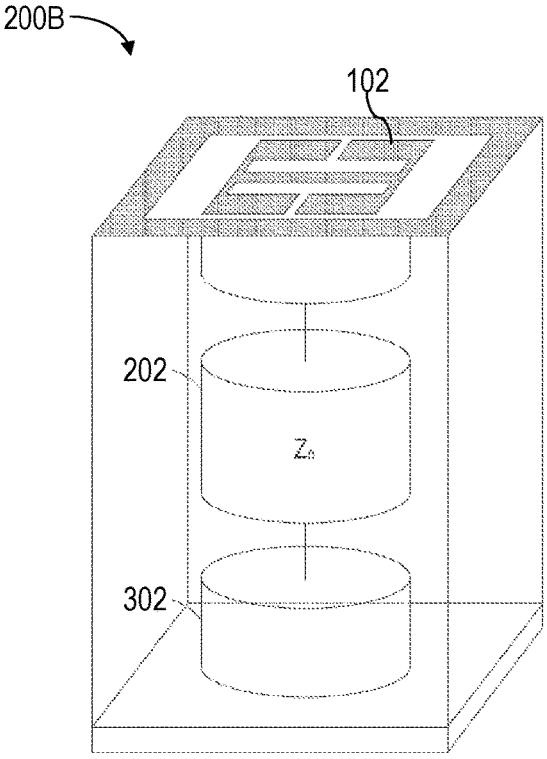
FIG. 3 illustrates a conceptual model of a tunable medium showing a close-up view of a single subwavelength antenna element.

FIG. 3 illustrates a conceptual model of a tunable medium 200B showing a close-up view of a single subwavelength antenna element 102 with an associated lumped impedance element, $z_n$, 202, and an impedance control input 302 that can be used to control or vary the impedance of the lumped impedance element, $z_n$, 202, according to one simplified embodiment.

Subwavelength antenna element 102 may be arranged in an array and may be configured for submersion in a fluid, such as fresh water, salt water, brackish water, or a particular gaseous environment.

As used herein, the term "metamaterial" refers to a tunable medium 200 (e.g., 200A, 200B) including subwavelength antenna elements 102 (e.g., antenna elements) spaced at subwavelength dimensions of an operational frequency. By way of non-limiting example, the subwavelength antenna elements 102 may include short dipoles, resonant dipoles, magnetic dipoles, other elements, and combinations thereof.

An expanded S-matrix approach may be used to account for mutual coupling between the subwavelength antenna elements 102, and reduce computational complexity. In some embodiments, the lumped impedance element, $z_n$, 202 includes a tunable capacitive element (e.g., a diode, a transistor, a variable dielectric constant material, a liquid crystal, etc.). In some embodiments, the lumped impedance element, $z_n$, 202 includes a variable resistive element (e.g., a diode, a transistor, etc.). In some embodiments, the lumped impedance element, $z_n$, 202 includes a variable inductance element.

To implement coherent power combining, off-diagonal elements of a product between a transmit (e.g., precoder) matrix A, a channel matrix H, and a receive (e.g., decoder) matrix B may be decreased below a predetermined tolerance, cancelled, or a combination thereof. There may be $N_{od}=D(D-1)/2$ of such off-diagonal elements.

Minimization (e.g., cancellation) of these off-diagonal elements of AHB (B=I where there is no coherent power combiner) may be achieved by using one or more tunable media 200 (e.g., metamaterial) layers with a total of $N_v \geq N_{od}$ degrees of freedom. For example, one layer with $N_1$ degrees of freedom may be applied as a precoder and another with $N_2$ degrees of freedom may be used as a decoder (e.g., coherent power combiner), where $N_1+N_2=N_v$. As a specific, non-limiting example, only one layer with $N_v$ degrees of freedom may be used at the rectenna in the antenna system 100 (FIG. 1). In some embodiments, however, any number of intermediate layers may be used in the rectenna of the antenna system 100 (FIG. 1), with coherent power combining distributed among the various layers. In embodiments where coherent power combining is performed using the tunable medium 200, a minimum number $N_v$ of degrees of freedom to achieve coherent power combining may scale quadratically with the number of power streams D.

Referring again to FIG. 1, various configurations of the tunable medium 200 are contemplated. In some embodiments, a tunable medium 200 embodied in a single physical body may be used. In some embodiments, the tunable medium 200 may be divided into more than one physical body (e.g., spread across spread-out subwavelength antenna elements 102, positioned so that the EM radiation 106 passes through multiple tunable media 200, etc.). In some embodiments, the tunable medium 200 is located in front of the subwavelength antenna elements 102 with a front side of the subwavelength antenna elements 102 facing generally towards the plurality of the transmitting elements 104 (e.g., transmitting EM radiating elements).

As used herein, the term "at least substantially in a forward direction" refers to directions within about 10 degrees of a front surface of a body carrying the receive EM radiating elements 102. Also by way of non-limiting example, the controller 112 may be programmed to control the tunable medium 200 to scatter (e.g., reflect) the EM radiation 106 at least substantially in a backward direction relative to the subwavelength antenna elements 102 (reflective backer mode). As used herein, the term "at least substantially in a backward direction" refers to a direction about 180 degrees from the at least substantially forward direction. As another non-limiting example, the controller 112 may be programmed to control the tunable medium 200 to scatter the EM radiation 106 at least substantially (i.e., within about 10 degrees) in a direction of a specular reflection relative to a surface of the body carrying the plurality of subwavelength antenna elements 102 (specular reflector at an arbitrary position).

As a further, non-limiting example, the controller 112 may be programmed to control the tunable medium 200 to scatter the EM radiation 106 at least substantially (i.e., within about 10 degrees) in a direction towards the subwavelength antenna elements 102 (arbitrary-angle reflector, arbitrary position). Accordingly, the controller 112 may be programmed to operate the tunable medium 200 in "reception" mode, but may also be programmed to operate the tunable medium 200 in "reflection" mode or "non-specular reflection" mode. In some embodiments, one or more of these modes may be used (in combination) to shape/control the incident EM radiation 106 so as to maximize the combined output current and/or the conversion efficiency between incident EM radiation 106 and combined output current.

Referring once again to FIG. 1, in some embodiments, the controller 112 may be programmed to determine (e.g., dynamically for a dynamic channel, statically for a static channel) a channel matrix H of channels between the subwavelength antenna elements 102 and the transmitting elements 104 (neglecting effects of the tunable medium 200), and tune (e.g., dynamically) the tunable medium 200 as a function of the determined channel matrix H. In some embodiments, the channel matrix H may be determined by at least one of transmitting and receiving one or more training signals, and analyzing received signal strength indicators (RSSIs) corresponding to the training signals. In some embodiments, the control circuitry 110 may store (e.g., in data storage) information indicating past determined channel matrices, and select one of the past determined channel matrices for current use.

While the subwavelength antenna elements 102 are receiving, the channel matrix H may include an N by M complex matrix (where N is a number of the subwavelength antenna elements 102 and M is the number of the transmitting EM radiating elements 104, and each element $h_{ab}$ including a fading coefficient of a channel from an $a^{th}$ transmitting EM radiating element 104 to a $b^{th}$ subwavelength antenna element 102, neglecting effects of the tunable medium 200. The channel matrix H describes linear relationships between the currents on transmitting elements 104 (e.g., the transmitting EM radiating elements 104) and subwavelength antenna elements 102. The channel matrix H is a discrete form of the Green's function of the channel. If the transmitting elements 104 and the subwavelength antenna elements 102 are viewed as input and output ports, respectively, the channel matrix H is also the same as the S-parameter matrix of a port network. In other words, a matrix product of a vector of far-end transmit signals X and the channel matrix H plus any noise W produces a vector of near-end receive signals Y, or equivalently Y=XH+W, again, neglecting the tunable medium 200.

The tunable medium 200 provides the ability to perform coherent power combining (e.g., decoding) of the receive signals Y. Specifically, the tunable medium 200 may be tuned to modify the receive signals Y received at the subwavelength antenna elements 102. For example, the receive signals Y may be expressed as a product of transmit signals X and a coherent power combining (e.g., decoder) matrix B of the tunable medium 200 multiplied by the channel matrix H, plus any noise W, or Y=XBH+W. As another example, the receive signals Y may be expressed as a product of transmit signals X, a precoder matrix A of the tunable medium 200 at the far-end (not shown), the channel matrix H, and a decoder matrix B of a tunable medium 200 at the near-end (e.g., rectenna), plus any noise W, or Y=XAHB+W. The product of the channel matrix H with any coder matrices (A, B, or a combination thereof) may be referred to herein as an "extended channel matrix" (e.g., AH, AHB), or H'.

In some embodiments, the controller 112 may be programmed to determine control parameters of the tunable medium 200 that result in approximately a desired extended channel matrix H'. By way of non-limiting example, the control parameters may be determined by solving an inverse scattering problem, with the inverse scattering problem postulated as an equality between a determined extended channel matrix $H'^{DET}$ and a desired extended channel matrix $H'^{GOAL}$ ($H'^{DET}=H'^{GOAL}$). For example, in some embodiments, the inverse scattering problem may be postulated as a minimization problem for the matrix norm of the difference between the determined channel matrix $H'^{DET}$ and the desired extended channel matrix $H'^{GOAL}$ ($\min\|H'^{DET}-H'^{GOAL}\|$, $\min\|H'^{GOAL}-H'^{DET}\|$, etc.). In some embodiments, the inverse scattering problem may be postulated as a least-squares problem with a minimization goal represented as a sum of squared differences between selected components (e.g., all the components, a portion of the components, etc.) of the determined extended channel matrix $H'^{DET}$ and corresponding components of the desired extended channel matrix $H'^{GOAL}$, or $\min_{\vec{p}} \Sigma_{(i,j)}|H'^{DET}_{ij}(\vec{p})-H'^{GOAL}_{ij}|^2$.

In some embodiments, the inverse scattering problem may be postulated as a least-squares problem with a minimization goal represented as a sum of squared differences between selected components (e.g., all the components, a portion of the components, etc.) of the determined extended channel matrix $H'^{DET}$ and corresponding components of the desired extended channel matrix $H'^{GOAL}$ plus a weighted sum of frequency dispersion magnitudes of the selected components, or:

$$\min_{\vec{p}} \sum_{(i,j)} \left\{ |H'^{DET}_{ij}(\vec{p}) - H'^{GOAL}_{ij}|^2 + w_{ij} \left| f_0 \left( \frac{\partial H'^{DET}_{ij}(\vec{p}, f)}{\partial f} \right)_{f=f_0} \right|^2 \right\}$$

where $f_0$ is a central frequency of an operation frequency band, and $w_{ij}$ are non-negative weights. The inclusion of the weighted sum of frequency dispersion magnitudes may be used to increase instantaneous bandwidth of the solution.

The tuning problem may be solved as an optimization problem with a number of variables equal to a number of degrees of freedom of the tunable medium 200. In some embodiments, an optimization function (e.g., minimizing a norm of a difference between a desired extended channel matrix and an observed extended channel matrix) may be defined as a sum of squares of off-diagonal elements of the determined extended channel matrix. As a specific, non-limiting example where there is a coherent power combiner (e.g., decoder) but no precoder, the extended channel matrix may be BH. In this example, the tuning algorithm may become essentially a form of the zero forcing algorithm, except that the coherent power combiner is implemented with a scattering/diffractive medium (i.e., the tunable medium 200) applied inside of the propagation channel as opposed to a circuit-based decoder applied to the signals after they enter the subwavelength antenna elements 102. This is essentially a generalization of a multiple-null steering approach to interference cancellation. For example, the $i^{th}$ subwavelength antenna element 102 may be surrounded by a null-forming adaptive layer of the tunable medium 200 that creates nulls at the location of each of the subwavelength antenna elements 102 except the $i^{th}$ subwavelength antenna element 102 that is intended to receive the signal from the $i^{th}$ far-end transmitting element 104.

It should be noted that although the tunable medium 200 is discussed herein as implementing a coherent power combiner or decoder, the tunable medium 200 may be equivalently thought of as a coding aperture, and the subwavelength antenna elements 102 may be equivalently regarded as corresponding receivers for the coded aperture. Accordingly, the disclosure contemplates that any of the embodiments discussed herein may be equivalently regarded in terms of the tunable medium 200 functioning as a decoder (e.g., coherent power combiner) and a coded aperture.

Figure 4:
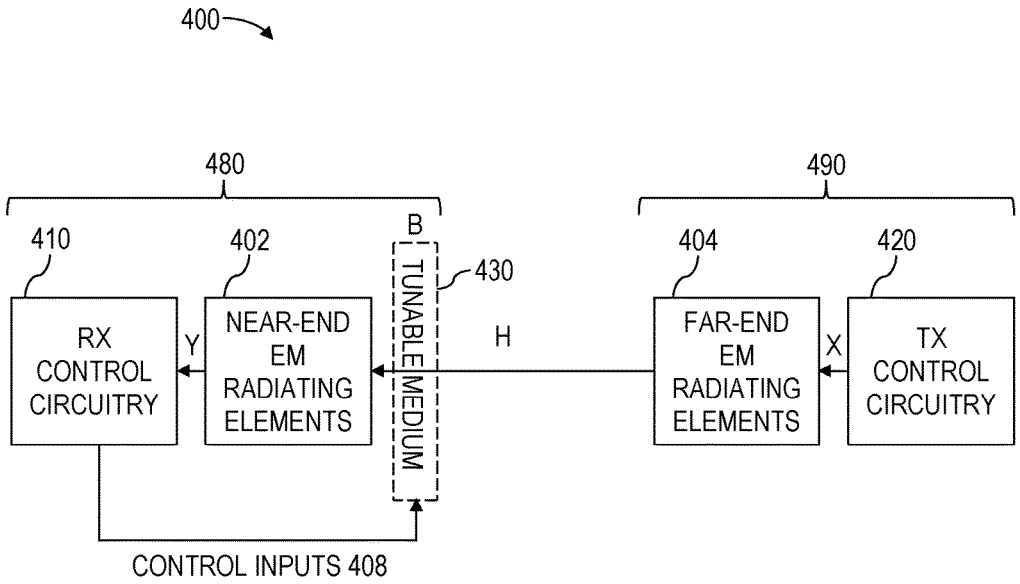
FIG. 4 is a simplified block diagram of an example of a system.

FIG. 4 is a simplified block diagram of an example of an antenna system 400 including near-end equipment 480 and far-end equipment 490. In the system 400 of FIG. 4 the near-end equipment 480 is configured to receive communications from the far-end equipment 490 (i.e., the near-end equipment is functioning as a receiver and the far-end equipment is functioning as a transmitter). The near-end equipment 480 includes receive control circuitry 410 operably coupled to near-end EM radiating elements 402 (e.g., subwavelength antenna elements 102) and a tunable medium 430 (e.g., tunable medium 200). The receive control circuitry 410 may be similar to the control circuitry 110 of FIG. 1, including rectifier circuitry and DC combining circuitry configured to generate a combined DC output current from the EM radiation signals Y and a controller configured to tune the tunable medium 430 (e.g., using control inputs 408). The far-end equipment 490 includes far-end EM radiating elements 404 operably coupled to transmit control circuitry 420 similar to the transmitting elements 104 of FIG. 1.

While the near-end EM radiating elements 402 are receiving, the channel matrix H may include an M by N complex matrix, and each element $h_{ba}$ may include a fading coefficient of a channel from a $b^{th}$ far-end EM radiating element 404 to an $a^{th}$ near-end EM radiating element 402. In other words, a matrix product of a vector of far-end transmit signals X transmitted by the far-end EM radiating elements 404 and the channel matrix H plus any noise W produces a vector of near-end receive signals Y received by the near-end EM radiating elements 402, or equivalently Y=XH+W.

The tunable medium 430 provides the ability to coherently combine the receive signals Y. Specifically, the tunable medium 430 may be tuned to modify the receive signals Y received at the near-end EM radiating elements 402. For example, the receive signals Y may be expressed as the product of transmit signals X and the channel matrix H multiplied by a coherently combining matrix B of the tunable medium 430, plus any noise W, or Y=XHB+W. Accordingly, the extended channel matrix H' may be expressed as HB in such instances.

In some embodiments, the receive control circuitry 410 may be programmed to tune the tunable medium 430 such that the product of the channel matrix H and the coherently combining matrix B of the tunable medium 430 is at least approximately equal to a diagonal matrix (e.g., by solving the inverse scattering problem using any of the approaches discussed above). The resulting receive signals Y would be given by XHB+W, which is approximately equal to a diagonal matrix, assuming that W is relatively small. In other words, the receive control circuitry 410 may be programmed such that the product of the channel matrix H and the coherently combining matrix B produces a matrix having off-diagonal elements, each of the off-diagonal elements having a magnitude that is less than or equal to a predetermined threshold value. In such embodiments, each element of the transmit signals X will be communicated to only one of the near-end EM radiating elements 402. Stated another way, the tunable medium 430 may act as a lens altering receive radiation patterns of the near-end EM radiating elements 402 to maximize the combined output current and/or the conversion efficiency between the transmitted radiation and the combined output current. As a result, the tunable medium 430 may function as a spatial multiplexing decoder.

As a specific, non-limiting example of how this spatial multiplexing decoder may be implemented, the receive control circuitry 410 may be programmed such that the coherently combining matrix B of the tunable medium 430 is at least approximately equal to a right pseudo-inverse of the channel matrix H (e.g., by solving the inverse scattering problem using any of the approaches discussed above). In such embodiments, the matrix product of the channel matrix H and the decoder matrix B is approximately equal to an identity matrix (i.e., the numbers in the main diagonal are ones, and the off-diagonal elements are zeros). A similar result may be obtained if the receive control circuitry 410 is programmed to tune the tunable medium 430 such that the decoder matrix B is the matrix inverse of the channel matrix H (assuming that H is square and non-singular).

Figure 5:
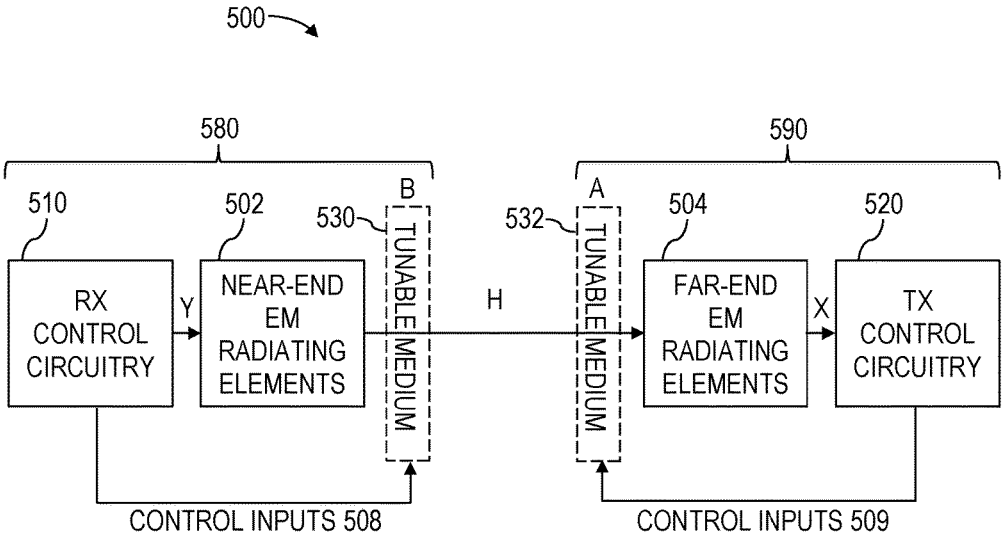
FIG. 5 is a simplified block diagram of another example of a system.

In some embodiments, tunable media such as the tunable medium 200 discussed with reference to FIG. 1 may be included in both near-end equipment and far-end equipment. FIG. 5 illustrates an example of such a system.

FIG. 5 is a simplified block diagram of another example of an antenna system 500 including near-end equipment 580 and far-end equipment 590. The near-end equipment 580 includes receive control circuitry 510 operably coupled to near-end EM radiating elements 502 (e.g., subwavelength antenna elements 102) and a tunable medium 530 (e.g., tunable medium 200). The receive control circuitry 510 is programmed to deliver receive signals Y resulting from transmit signals X at the far-end EM radiating elements 504 to the receive control circuitry 510 (to rectifier circuits, for example) and tune the tunable medium 530 (e.g., using control inputs 508). The transmit control circuitry 510, the near-end EM radiating elements 502, and the tunable medium 530 may be similar to the control circuitry 110, the subwavelength antenna elements 102, and the tunable medium 200, respectively, as discussed above with reference to FIG. 1.

The far-end equipment 590 includes transmit control circuitry 520 operably coupled to far-end EM radiating elements 504 and a tunable medium 532. The far-end EM radiating elements 504 are configured to provide transmit signals X to the near-end EM radiating elements 502. The transmit control circuitry 520 is configured to transmit the transmit signals X, and tune the tunable medium 532 (e.g., using control inputs 509). The transmit control circuitry 520, the far-end EM radiating elements 504, and the tunable medium 532 may be similar to the control circuitry 110, the subwavelength antenna elements 102, and the tunable medium 200, respectively, as discussed above with reference to FIG. 1.

The receive signal Y received by the receive control circuitry 510 may be expressed as Y=XAHB+W, where X is the transmit signal, A is a precoder matrix of the tunable medium 532, H is the channel matrix, B is a coherent power combining (e.g., decoder) matrix of the tunable medium 530, and W is any noise. Coding (e.g., precoding, decoding) may be performed at the near-end equipment 580, the far-end equipment 590, or a combination thereof. In some embodiments the far-end equipment 590 may be configured to transmit wireless power and the near-end equipment 580 may be configured to receive wireless power and convert the wireless power into DC current (act as a rectenna, for example). It is noted that in this configuration with tunable mediums at both the near-end equipment 580 and far-end equipment 590, the extended channel matrix H' may be expressed as AHB.

In some embodiments, the receive control circuitry 510 and the transmit control circuitry 520 may be programmed to tune the tunable media 530, 532, respectively, such that the matrix product AHB is at least approximately equal to a diagonal matrix (e.g., by solving the inverse scattering problem using any of the approaches discussed above). The resulting receive signals Y would be given by XAHB+W, which is approximately equal to a diagonal matrix, assuming that W is relatively small. In other words, the off-diagonal elements of the matrix product AHB produce a matrix having off-diagonal elements, each of the off-diagonal elements having a magnitude that is less than or equal to a predetermined threshold value. In such embodiments, each element of the transmit signals X will be communicated to only one of the near-end EM radiating elements 502. Stated another way, the tunable media 530, 532 may act as lenses altering radiation patterns of the near-end EM radiating elements 502 and the far-end EM radiating elements 504 to include peaks and nulls configured to implement spatial multiplexing coders. As a result, the tunable media 530, 532 may function as coherent power combiners or spatial multiplexing coders.

As a specific, non-limiting example of how this spatial multiplexing coding may be implemented, the transmit control circuitry 520 may be programmed such that a precoder matrix of the tunable medium 532 is at least approximately equal to $U^{\dagger}$, where $U\Sigma V^{\dagger}$ is a singular value decomposition of the channel matrix H, and $U^{\dagger}$ is the conjugate transpose of unitary matrix U (e.g., by solving the inverse scattering problem using any of the approaches discussed above). Also, the receive control circuitry 510 may be programmed such that the decoder matrix B of the tunable medium 530 is at least approximately equal to V, where V is the conjugate transpose of $V^{\dagger}$. In such embodiments, the matrix product of the precoder matrix A, the channel matrix H, and the decoder matrix B is approximately equal to a diagonal matrix (i.e., the numbers in the main diagonal are the singular values of the channel matrix H, and the off-diagonal elements are zeros) (e.g., by solving the inverse scattering problem using any of the approaches discussed above). A similar result (except that the diagonal elements of AHB are the eigenvalues of the channel matrix H instead of the singular values) may be obtained if the transmit control circuitry 520 tunes the tunable medium 532 such that the precoder matrix A is approximately equal to $Q^{-1}$, and the receive control circuitry 510 tunes the tunable medium 530 such that the decoder matrix B is approximately equal to Q, where $Q\Lambda Q^{-1}$ is the eigenvalue decomposition of the channel matrix H (assuming that H is a diagonizable matrix), and $Q^{-1}$ is the matrix inverse of the matrix Q.

In some embodiments where power streams are transmitted from the far-end equipment 590 to the near-end equipment 580, there may be a number D of power streams, $N_r$ near-end EM radiating elements 502 ($N_r \geq D$), and $N_t$ far-end EM radiating elements 504. As previously discussed, the $N_t$ far-end EM radiating elements 504 may be collocated within a single device, or distributed arbitrarily between any number $N_u$ of users (e.g., separate physical devices), where $1 \leq N_u \leq N_t$. In such embodiments, a precoder matrix A of the tunable medium 530 is of size D-by-$N_t$, the channel matrix H is $N_t$-by-$N_r$, and the decoder matrix B is $N_r$-by-D. In such instances, the full demultiplexed matrix AHB is a square, Hermitian matrix of size D-by-D. This matrix is automatically symmetric because the combination of the original propagation channel H and the two coding tunable media 530, 532 may itself be viewed as a propagation channel AHB. Assuming that this channel is reciprocal leads to the conclusion that the combined channel matrix AHB is Hermitian.

In embodiments disclosed herein, the tunable medium 532 functioning as a precoder may be placed between the $N_t$ far-end EM radiating elements 504 and the propagation channel, and the tunable medium 530 functioning as a decoder may be placed between the $N_r$ near-end EM radiating elements 502 and the propagation channel. In some such embodiments, the number of power steams D may match the number of near-end EM radiating elements 502 receiving the power streams. Moreover, in some embodiments, $N_t = N_r = D$. In some embodiments, the number of far-end EM radiating elements 504 may vary dynamically (e.g., as the number $N_r$ receiving near-end EM radiating elements 502 dynamically changes).

It is appreciated that optimizing the tuning of the individual subwavelength antenna elements 102 or groups of tunable receive EM radiating elements to maximize total output current and/or to maximize conversion efficiency may be done in a wide variety of manners. Many of these approaches, however, result in one or a small number of potential tuning solutions, without giving any assurance that any of these solutions represent the best solution (global optimum) and/or without providing any indication of how close to the global optimum the solution might be. Exhaustive computations using traditional methods may be too computationally intensive and/or infeasible for real-time tuning and for switching.

The complexity of the optimization problem may increase rapidly with the complexity of the device. In many embodiments, the complexity increases exponentially with the number of subwavelength antenna elements 102. In addition, the complexity increases exponentially with the number of rectifiers, the resistance characteristics of the number of rectifiers, the DC combining circuitry, and/or the resistance characteristics of the DC combining circuitry. As noted above, the resistance of the rectifier circuitry and/or the DC combining circuitry impacts the aperture size of the receive antenna. As a result, received EM radiation may be reflected back into the tunable medium from the rectifier circuitry. Since the rectifier circuitry and/or the DC combining circuitry impact the resistance experienced at the tunable medium and thus the receive aperture size, the entire system needs to be optimized as a whole.

Standard optimization approaches for tuning an array of tunable receive EM radiating elements 102 may require cost functions to be evaluated a large number of times. The number of subwavelength antenna elements 102 of the rectenna of the antenna system 100, the number of tunable resistances of the rectifier circuitry and/or DC combining circuitry, and other tunable receive EM radiating elements of the antenna system may be expressed as the degrees of freedom (DoF) of the antenna system. The DoF may be based on the number of subwavelength antenna elements 102, associated tunable elements, and/or other tunable or adjustable components associated with the rectenna 100 and the overall antenna system. As the DoF increases, the complexity is likely to increase exponentially, leading to optimization problems for which global or even quasi-global solutions are prohibitively computationally expensive for even moderate device complexity.

The antenna systems and related methods disclosed herein provide optimization solutions for arrays of subwavelength antenna elements (e.g., tunable EM scattering elements) and associated tunable (i.e., variable) lumped impedance elements in which the optimization solutions are rational multivariate functions. Accordingly, globally optimal solutions may be found by solving optimization problems that scale linearly with the DoF instead of exponentially. The optimization approach can be simplified by making the cost function dependent on one matrix-value input (such as an impedance matrix, Z-matrix) that can be calculated by performing no more than N linear system simulations. In the present application, N is an integer corresponding to the number of variable (e.g., tunable) impedance elements associated with an antenna system.

The cost function, although still non-linear, may have a specific rational form that permits exhaustive enumeration of all local extrema. A global maximum (or minimum) can be selected from the local extrema. For rational function, the extrema are found by solving multivariate polynomial equations. Root enumeration and/or numerical calculations of the multivariate polynomial equations may allow for specialized treatment.

Tunable metamaterials, including two-dimensional metasurface devices, may comprise an array of unit cells. Each unit cell may be modeled as a subwavelength antenna element associated with one or more variable impedance elements (e.g., the variable impedance elements 202). Each variable impedance element may be associated with one or more subwavelength antenna elements. Each impedance element or group of impedance elements may be variably controlled based on one or more impedance control inputs. The tuning may be a one-time static tuning that is performed during the manufacturing of the antenna device, or the tuning may be a dynamic process that occurs during operation by modifying one or more control inputs.

As an example of static tunability, a metamaterial device may be manufactured using a 3D printer and the tuning may comprise selecting a material or combination of materials that results in a specific electromagnetic or electrical property for each of the impedance elements. By uniquely selecting the material or combination of materials for each of the unit cells, a metamaterial antenna device may be statically tuned to a specific radiation pattern. Alternatively, each unit cell may be modeled to include a lumped impedance element with (at least) one input and (at least) one output. The input(s) may be dynamically manipulated during operation to dynamically tune the antenna device in real-time to allow for a wide range of selectable target radiation patterns.

As previously described, the system may be modeled to include lumped impedance elements that can be passive, active, or variably passive-active. At a given frequency, each impedance element may be fully described by the complex value of its impedance "z." A positive integer N may be used to describe the number of tunable or variable lumped impedance elements in an antenna system. A diagonal square matrix of size N may have diagonal elements $z_n$ representative of the nth elements of the antenna system. Alternatively, an N-dimensional complex vector, $\{z_n\}$, can be used to represent the n-valued list of impedance values.

Each variable impedance element may be modeled as a port (e.g., a lumped port and/or a wave port). A plurality of lumped ports, N, may include a plurality of internal lumped ports, $N_a$, internal to the tunable medium 200 (one for each of the subwavelength antenna elements 102, for example) and with impedance values corresponding to the impedance values of each of the variable impedance elements, and at least one lumped external port (e.g., associated with the near-end EM radiating elements (e.g., subwavelength antenna elements 102) and the far-end EM radiating elements (e.g., transmitting elements 104)), $N_e$, that may or may not have a variable impedance or any impedance at all. That is, the z value of the modeled lumped external port, $N_e$, may be zero and represent an idealized shorted port. Alternatively, the z value of the modeled lumped external port, $N_e$, may be infinity and represent an idealized open port. In many embodiments, the z value of the external port, $N_e$, may be a complex value with a magnitude between zero and infinity. In some embodiments, each of the tunable resistances of the rectifier circuitry and the tunable resistances of the DC combining circuitry may be modeled as a lumped external port, $N_e$.

Regardless of the impedance values of each of the lumped ports, N, including the internal lumped ports, $N_a$, and the at least one lumped external port, $N_e$, each of the lumped ports (or in some embodiments wave ports) may have its own self-impedance and the network of ports may be described by an N×N impedance matrix (Z-matrix) or by the equivalent inverse admittance matrix (Y-matrix) where $Y=Z^{-1}$. Additionally, the network of ports can be modeled as an S-parameter matrix or scattering matrix (S-matrix). The Z-matrix and its inverse the Y-matrix are independent from the specific z values of the ports because the matrix elements are defined as $Z_{nm}=V_n/I_m$, where $V_n$ and $I_m$ are the voltage at port n and the current at port m, measured with all other ports open. That is, assuming port currents $I_k=0$ for all k are not equal to m or n. Similarly, for the admittance matrix, $Y_{nm}=I_m/V_n$, measured with all other ports open. Again, that is assuming port currents $I_k=0$ for all k are not equal to m or n.

The S-matrix is expressible through the Z or Y matrices and the values of the lumped impedance elements as follows:

$$S=(\sqrt{y}Z\sqrt{y}-1)(\sqrt{y}Z\sqrt{y}+1)^{-1}=(1-\sqrt{z}Y\sqrt{z})(1+\sqrt{z}Y\sqrt{z})^{-1}$$

In the equation above, the "1" represents a unit matrix of size N. The S-matrix models the port-to-port transmission of off-diagonal elements of the N-port antenna system. In a lossless system, the S-matrix is necessarily unitary. If elements $s_n$ are the singular values of the S-matrix, which are the same as the magnitudes of the eigenvalues, it can be stated that in a lossless system, all $s_n=1$. In general, if $s_{max}$ is the largest singular value, then for a passive lossy system it can be stated that $s_n \leq s_{max} \leq 1$.

In an active system, these bounds still hold; however, $s_{max}$ can now exceed unity, representing an overall power gain for at least one propagation path. The Z and Y matrices are diagonalized in the same basis represented by a unitary matrix U ($U^{\backslash}=U^{-1}$), such that $Z=U^{\backslash}Z_dU$, $Y=U^{\backslash}Y_dU$, where the subscript d indicates a diagonal matrix, the elements of which are complex-valued eigenvalues of the corresponding matrix.

Generally speaking, unless $\sqrt{z}$ is proportional to a unit matrix (i.e., all lumped element impedances are equal), the S-matrix will not be diagonal in the U-basis. In the U-basis, the general form of the S-matrix is $S=U^{\backslash}(1-\zeta Y_d\zeta)(1+\zeta Y_d\zeta)^{-1}U$, where a new non-diagonal matrix $\zeta=U\sqrt{z}U^{\backslash}$ is used such that $\sqrt{z}=U^{\backslash}\zeta U$, and $Y_d$ is diagonal, though not generally commutative with $\zeta$.

The S-matrix of the system can be numerically evaluated with any desired accuracy by solving exactly N linear system problems (e.g., $Z_{nm}=V_n/I_m$ or $Y_{nm}=I_m/V_n$ and the associated open port conditions described above). Such problems may be solved with Finite Element Methods (FEM) or finite-difference time-domain (FDTD) based solvers for linear electromagnetic systems. Examples of commercially available solvers include ANSYS HFSS, COMSOL, and CST. These numerical simulations incorporate various fine effects of the near-field and far-field interactions between various parts of the system, regardless of complexity.

The Z-matrix and/or the Y-matrix can be evaluated based on a knowledge of the S-matrix and the impedance values. With many FEM solvers, it is also possible to directly evaluate the Z-matrix or the Y-matrix, by solving $N^2$ linear problems. This approach, however, is N times less efficient than calculating the S-matrix with a fixed set of port impedance values (known as reference impedance values) and transforming it to Z and/or Y.

In various embodiments, an antenna system (e.g., the antenna system 100) may include a plurality of subwavelength antenna elements (e.g., the tunable EM scattering elements 220). The subwavelength antenna elements may each have a maximum dimension that is less than one-half of a wavelength of the smallest frequency within a base frequency range. One or more of the subwavelength antenna elements may comprise a resonating element. In various embodiments, some or all of the subwavelength antenna elements may comprise metamaterials. In other embodiments, an array of the subwavelength antenna elements (e.g., resonating elements) may be collectively considered a metamaterial.

The subwavelength antenna elements may have inter-element spacings that are substantially less than a free-space wavelength corresponding to a base frequency or frequency range. For example, the inter-element spacings may be less than one-half or one-quarter of the free-space operating wavelength. The antenna system may be configured to operate in a wide variety of base frequency ranges, including, but not limited to, microwave frequencies. The presently described systems and methods may be adapted for use with other frequency bands, including those designated as very low frequency, low frequency, medium frequency, high frequency, very high frequency, ultra-high frequency, super-high frequency, and extremely high frequency or millimeter waves. In some cases, the base frequency may be associated with a series of harmonic frequencies, where each harmonic frequency in the series of harmonic frequencies has a frequency that is a positive integer multiple of the base frequency (e.g., fundamental frequency).

In some embodiments, each of the subwavelength antenna elements is associated with at least one lumped impedance element. In some embodiments, the impedance of the lumped impedance element may be frequency dependent. So the lumped impedance element may have first impedance at the base frequency, a second impedance at the first harmonic frequency, a second impedance at the second harmonic frequency, and so forth. Each lumped impedance element may have a variable impedance value that may be at least partially based on the connected subwavelength antenna element(s) and/or a connected rectifier/combiner circuitry. As noted above, the one or more aspects of the rectifier/combiner circuitry may be modeled as another port in the S-matrix, such as in Heretic-like architectures with variable couplers.

The impedance of each of the lumped impedance elements may be variably adjusted through one or more impedance control inputs. The number of subwavelength antenna elements, associated impedance elements, and the number of impedance control inputs may be a 1:1:1 ratio or an X:Y:Z, where X, Y, and Z are integers that may or may not be equal. For instance, in one embodiment there may be a 1:1 mapping of impedance elements to subwavelength antenna elements while there is only one-tenth the number of impedance control inputs.

In various embodiments, the modeled lumped external port, $N_e$, may or may not be associated with a variable impedance element. In some embodiments, the lumped external port, $N_e$, is modeled as an external port with an infinitesimal volume located at a particular radius-vector relative to the antenna device. The lumped external port, $N_e$, may be in the far-field of the antenna device, the radiative near-field of the antenna device, or the reactive near-field of the antenna device.

In some embodiments, the lumped external port, $N_e$, may comprise a virtual port, an external region of space assumed to be a void, a region of space assumed to be filled with a dielectric material, and/or a location in space assumed to be filled with a conductive, radiative, reactive, and/or reflective material. In at least some embodiments, the lumped external port, $N_e$, comprises the combined output of the DC combining circuitry.

The lumped external port, $N_e$, may also be modeled as a virtual external port, such as a field probe, as measured by a non-perturbing measurement. In other embodiments, the virtual external port may represent a numerical field probe, as calculated using a numerical simulation.

As previously described, in some embodiments, a unique lumped impedance element may be associated with each of the subwavelength antenna elements 102. In other embodiments, a plurality of tunable EM scattering elements 220 may be grouped together and associated with a single, variable, lumped impedance element. Conversely, a plurality of lumped impedance elements may be associated with a single subwavelength antenna element. In such an embodiment, the impedance of each of the plurality of lumped impedance elements may be controlled individually, or only some of them may be variable. In any of the above embodiments, X impedance control inputs may be varied to control the impedance of Y lumped impedance elements, where X and Y are integers that may or may not be equal.

As a specific example, 1,000 unique impedance control inputs may be provided for each of 1,000 unique lumped impedance elements. In such an embodiment, each of the impedance control inputs may be varied to control the impedance of each of the lumped impedance elements. As an alternative example, 1,000 unique lumped impedance elements may be controlled to be variably addressed by a binary control system with 10 inputs.

In some embodiments, one or more of the impedance control inputs may utilize the application of a direct current (DC) voltage to variably control the impedance of the lumped impedance element based on the magnitude of the applied DC voltage. In other embodiments, an impedance control input may utilize one or more of an electrical current input, a radiofrequency electromagnetic wave input, an optical radiation input, a thermal radiation input, a terahertz radiation input, an acoustic wave input, a phonon wave input, a mechanical pressure input, a mechanical contact input, a thermal conduction input, an electromagnetic input, an electrical impedance control input, and a mechanical switch input. In various embodiments, the lumped impedance elements may be modeled as two-port structures with an input and an output.

The lumped impedance elements may comprise one or more of a resistor, a capacitor, an inductor, a varactor diode, a diode, a MEMS capacitor, a BST capacitor, a tunable ferroelectric capacitor, a tunable MEMS inductor, a pin diode, an adjustable resistor, an HEMT transistor, and/or another type of transistor. Any of a wide variety of alternative circuit components (whether in discrete or integrated form) may be part of a lumped impedance element.

One or more hardware, software, and/or firmware solutions may be employed to perform operations for coding (e.g., linear coding) by controlling the impedance values of the lumped impedance elements via the one or more impedance control inputs. For instance, a computer-readable medium (e.g., a non-transitory computer-readable medium) may have instructions that are executable by a processor to form a specific coder (e.g., precoder, decoder). The executed operations or method steps may include determining a scattering matrix (S-matrix) of field amplitudes for each of a plurality of lumped ports, N.

The lumped ports, N, may include a plurality of internal lumped ports, $N_a$, with impedance values corresponding to the impedance values of the plurality of physical impedance elements (e.g., the tunable EM scattering elements 220). In at least some embodiments, the modeled lumped ports, N, include at least one external port, $N_e$, that is located physically external to the antenna system. In some embodiments, the lumped ports, N, also include a TL or other waveguide as another lumped port for the calculation of the S-matrix.

The S-matrix is expressible in terms of an impedance matrix, Z-matrix, with impedance values, $z_n$, of each of the plurality of lumped ports, N. Thus, by modifying one or more of the impedance values, $z_n$, associated with one or more of the plurality of lumped ports, N, a desired S-matrix of field amplitudes can be attained. The operations or method steps may include identifying a target coherent power combiner matrix (e.g., decoder, etc.) of the rectenna 100 defined in terms of target field amplitudes in the S-matrix for the at least one lumped external port, $N_e$ (that maximizes the combined current output and/or the conversion efficiency at the DC combining circuitry, for example).

An optimized port impedance vector $\{z_n\}$ of impedance values $z_n$ for each of the internal lumped ports, $N_a$, may be calculated that results in S-matrix elements for the one or more lumped external ports, $N_e$, that approximates the target coder for a given base frequency. Once an optimized $\{z_n\}$ is identified that will result in the desired field amplitude values for the S-matrix elements of the one or more lumped external ports, $N_e$, the variable impedance control inputs may be adjusted as necessary to attain the optimized $\{z_n\}$.

As an example, a target coder may correspond to a diagonal portion of an S-matrix that relates electric fields and current outputs at lumped external ports, $N_e$. Any number of lumped external ports, $N_e$, may be used as part of the S-matrix calculation. In some embodiments, the lumped external ports, $N_e$, include the current output of each rectifier circuit and/or the total current output of the DC combining circuitry. Using a plurality of lumped external ports, $N_e$, may allow for the definition of a coder that maximizes total output current and/or conversion efficiency given a pattern of EM radiation having a particular base frequency. Thus, the S-matrix may be calculated with a plurality of lumped external ports located external to the antenna device.

In various embodiments, at least one of the plurality of internal lumped ports, $N_a$, is strongly mutually coupled to at least one other internal lumped port, $N_a$. In some embodiments, at least one of the lumped external ports, $N_e$, is mutually coupled to one or more of the internal lumped ports, $N_a$. Strongly mutually coupled devices may be those in which an off-diagonal Z-matrix element, $Z_{ij}$, is greater in magnitude than one-tenth of the max $(|Z_{ii}|, |Z_{jj}|)$.

Determining an optimized $\{z_n\}$ may include calculating an optimized Z-matrix using one or more of a variety of mathematical optimization techniques. For example, the optimized $\{z_n\}$ may be determined using a global optimization method involving a stochastic optimization method, a genetic optimization algorithm, a Monte-Carlo optimization method, a gradient-assisted optimization method, a simulated annealing optimization algorithm, a particle swarm optimization algorithm, a pattern search optimization method, a Multistart algorithm, and/or a global search optimization algorithm. Determining the optimized $\{z_n\}$ may be at least partially based on one or more initial guesses. Depending on the optimization algorithm used, the optimized values may be local optimizations based on initial guesses and may not in fact be true global optimizations. In other embodiments, sufficient optimization calculations are performed to ensure that a true globally optimized value is identified. In some embodiments, a returned optimization value or set of values may be associated with a confidence level or confidence value that the returned optimization value or set of values corresponds to global extrema as opposed to local extrema.

For gradient-assisted optimization, a gradient may be calculated analytically using an equation relating an S-parameter of the S-matrix to the Z-matrix and the optimized $\{z_n\}$. In some embodiments, a Hessian matrix calculation may be utilized that is calculated analytically using the equation relating the S-parameter to the Z-matrix and the optimized $\{z_n\}$. A quasi-Newton method may also be employed in some embodiments. In the context of optimization, the Hessian matrix may be considered a matrix of second derivatives of the scalar optimization goal function with respect to the optimization variable vector.

In some embodiments, the global optimization method may include exhaustively or almost exhaustively determining all local extrema by solving a multivariate polynomial equation and selecting a global extrema from the determined local extrema. Alternative gradient-based methods may be used, such as conjugate gradient (CG) methods and steepest descent methods, etc. In the context of optimization, a gradient may be a vector of derivatives of the scalar optimization goal function with respect to the vector of optimization variables.

Exhaustively determining all local extrema may be performed by splitting the domain based on expected roots and then splitting it into smaller domains to calculate a single root or splitting the domain until a domain with a single root is found. Determining the optimized $\{z_n\}$ may include solving the optimization problem in which a simple case may include a clumped function scalar function with one output and N inputs. The N inputs could be complex $z_n$ values and the optimized Z-matrix may be calculated based on an optimization of complex impedance values of the $z_n$ vectors.

The optimized $\{z_n\}$ may be calculated by finding an optimized Z-matrix based on an optimization of complex impedance values $z_n$. The optimized $\{z_n\}$ may be calculated by finding an optimized Z-matrix based on an optimization of roots of complex values of the impedance values $z_n$. The optimized $\{z_n\}$ may be calculated by finding an optimized Z-matrix based on an optimization of reactances associated with the impedance values of the impedance values $z_n$. The optimized $\{z_n\}$ may be calculated by finding an optimized Z-matrix based on an optimization of resistivities associated with the impedance values of the impedance values $z_n$. The optimization may be constrained to allow only positive or inductive values of reactances, or only negative or capacitive values of reactances. In other embodiments, the optimization of resistivities may be constrained to only allow for positive or passive values of resistivities.

The optimized $\{z_n\}$ may be calculated by finding an optimized Z-matrix based on an optimization of the impedance control inputs associated with the lumped impedance elements of each of the tunable EM scattering elements 220. The optimized $\{z_n\}$ may be calculated by optimizing a non-linear function. The non-linear function may relate impedance values for each of the internal lumped ports, $N_a$, as modeled in the S-matrix and the associated impedance control inputs. In some embodiments, the non-linear function may be fitted to a lower-order polynomial for optimization.

Mapping the Z-matrix values to the S-matrix values may include a non-linear mapping. In some instances, the mapping may be expressible as a single or multivariate polynomial. The polynomial may be of a relatively low order (e.g., 1-5). The S-matrix may comprise N values and the Z-matrix may comprise M values, where N and M are both integers and equal to each other, such that there is a 1:1 mapping of S-matrix values and Z-matrix values. Any of a wide variety of mappings are possible. For example, the S-matrix may comprise N values and the Z-matrix may comprise M values, where N squared is equal to M. Alternatively, there may be a 2:1 or 3:1 mapping or a 1:3 or 2:1 mapping.

The physical location of the at least one lumped external port, $N_e$, may be associated with a single-path or multipath propagation channel that is electromagnetically reflective and/or refractive. The multipath propagation channel may be in the near-field. In a radiative near-field, the multipath propagation pattern may be in the reactive near-field.

As previously described, the field amplitudes in the S-matrix may be used to define a target coder. In some embodiments, the target coder may be defined in terms of a target field amplitude for a single linear field polarization. The target radiation pattern may be defined in terms of a plurality of field amplitudes for a plurality of lumped external ports, $N_e$. The target radiation pattern may be defined in terms of a target field amplitude for at least two linear polarizations.

The target field amplitudes for one or more lumped external ports, $N_e$, may be selected to decrease far-field sidelobes of the antenna system 100, decrease a power level of one or more sidelobes of the antenna system 100, change a direction of a strongest sidelobe of the antenna system 100, increase a uniformity of a radiation profile in the near-field, and/or minimize a peak value of field amplitudes in the near-field. The system may utilize a minimax approximation algorithm to minimize a peak value of field amplitudes in the near-field.

Determining the optimized $\{z_n\}$ of impedance values for each of the internal lumped ports, $N_a$ (e.g., the tunable EM scattering elements 220), may include determining an optimized set of control values for the plurality of impedance control inputs that results in a field amplitude for the at least one lumped external port, $N_e$, in the S-matrix that approximates the target field amplitude for a given frequency range.

In conformity with the antenna systems and associated methods described above, a plurality of internal lumped ports, $N_a$, with impedance values corresponding to the impedance values of each of the plurality of lumped impedance elements may be considered jointly with one or more external ports, $N_e$, whose purpose is to account for the field intensity at a particular location exterior to the tunable medium 200. The external port, $N_e$, may represent an actual transmit or receive antenna (e.g., the far-end EM radiating elements 104 or the near-end EM radiating elements 102), in which case a known input impedance of that port may be assigned to the external port, $N_e$. In other embodiments, the one or more external ports, $N_e$, may be merely conceptual and used to quantify one or more field intensities at one or more locations. The external port, $N_e$, may be assumed infinitesimal in area and/or volume and located at a particular radius-vector $\vec{r}_0$.

Regardless of the number of external ports, $N_e$, the total number of ports, N, will correspond to the number of internal lumped ports, $N_a$, and the number of external ports, $N_e$. In some embodiments, a common port (e.g., a waveguide or TL) associated with the antenna system may also be considered. In any such embodiments, the total size of the system matrices will be generally of size N, which does not grow exponentially with the degrees of freedom or number of variable impedance elements.

The S-matrix element $S_{1N}$ represents the complex magnitude of field (e.g., electric field) at a particular location in space, given by the radius vector $\vec{r}_0$, normalized to the field magnitude at the input port. The absolute value $|S_{1N}|$, or the more algebraically convenient quantity $|S_{1N}|^2$, quantifies the quality of field concentration at that point. Maximizing this quantity (or minimizing in the case of forming nulls) represents a generalized beamforming algorithm.

In some embodiments, the location $\vec{e}_0$ is in the far-field of the rest of the system, and the algorithm yields directive beams in the far-field. In other embodiments, the point $\vec{e}_0$ is in the radiative near-field of the rest of the system, and the algorithm yields field focusing to that point. In still other embodiments, the point $\vec{r}_0$ is within the reactive near-field of at least one part of the rest of the system, and the algorithm maximizes electric field intensity and electric energy density at that point.

To find all local optima and the global optimum we can use the equation $q_n \equiv \sqrt{z_n}$, which characterizes the individual port impedances $z_n$. The equation above, $S=U^{\backprime}(1-\zeta Y_d\zeta)(1+\zeta Y_d\zeta)^{-1}U$, is a rational (and meromorphic) analytical function of $\{q_n\}$.

To make this function bounded, and find its maxima that are attainable in a passive system, the function may be restricted to the multidimensional segment satisfying $\mathrm{Re}(z_n)\geq 0$, n=1, . . . , N. Equivalently, this condition is $-\pi/2\leq \arg z_n\leq \pi/2$, and consequently $-\pi/4\leq \arg q_n\leq \pi/4$.

To reduce this problem to real values, each $q_n$ variable can be expressed through real variables, $q_n=\rho_n+i\zeta_n$. In this manner, the real valued function $|S_{1N}|^2$ is now a function of 2N real variables $\rho_n$, $\zeta_n$, which is a rational function comprising a ratio of two 2N-variate polynomials.

In some embodiments, the resistance of each lumped element can be neglected by assuming $\mathrm{Re}(z_n)=0$, $z_n=ix_n$, with the real reactance values $x_n$. In such embodiments, the system as a whole is still assumed passive and lossy with the losses occurring on the paths between the ports and incorporated into the Z-matrix (or Y-matrix). This approximation satisfies the passivity constraints and also reduces the number of variables to N because $\sqrt{z}Y\sqrt{z}\rightarrow i\sqrt{x}Y\sqrt{x}$, and x is purely real.

The function $|S_{1N}|^2$ is necessarily bounded for a passive system, and therefore it has a finite global maximum as a function of real-valued variables $\rho_n$, $\zeta_n$. Moreover, it has a finite number of local extrema. These extrema can be found by solving a set of 2N multivariate polynomial equations given by the standard zero gradient condition at the extremum:

$$\frac{\partial|S_{1N}|^2}{\partial\rho_n}=0,\ \frac{\partial|S_{1N}|^2}{\delta\xi_n}=0,\ n=1,\ldots,N.$$

In the simplified approach above, there are N unknowns $x_n=\sqrt{x_n}$ and N extremum conditions, so $$\frac{\partial|S_{1N}|^2}{\delta\chi_n}=0,\ n=1,\ldots,N.$$

Once these extrema are found, the extremal values of the function are evaluated numerically, and the global maximum is determined by choosing the largest local maximum. A similar approach can be performed to identify one or more minimums to attain a target radiation pattern with a null at one or more specific radius vectors $\vec{r}_0$.

Numerical and symbolic-manipulation algorithms exist that take advantage of the polynomial nature of the resulting equations. For example, Wolfram Mathematica™ function Maximize supports symbolic solving of the global optimization problem for multivariate polynomial equations, unconstrained or with multivariate polynomial constraints. This function is based on a Groebner-basis calculation algorithm, which reduces the multidimensional polynomial system to a triangular system, which is then reduced to a single scalar polynomial equation by back-substitution. Similar functionality exists in other software packages, including MATLAB™ with Symbolic Math Toolbox™, Maple™ and so on.

As previously discussed, once values are determined for each of the $z_n$ for the variable or tunable lumped impedance elements associated with the tunable EM scattering elements 220, each of the tunable EM scattering elements 220 can be tuned. In some embodiments, the tuning is static and the impedance values are set at the manufacturing stage. In other embodiments, a physical stimulus (e.g., mechanical, electric, electromagnetic, and/or a combination thereof) may be used to dynamically tune tunable EM scattering elements 220 to dynamically modify the radiation pattern of the rectenna 100 during operation.

Depending on the manufacturing techniques employed (e.g., 3D printing) the calculated values of optimum impedance values may translate trivially into the choices made for the selectable impedance elements. In contrast, for the dynamically adjustable, variable, or tunable impedance elements, there is generally a non-trivial relationship between the complex impedance of the elements and the stimuli that control them. In some embodiments, the relationship between the complex impedance of the impedance elements and the control inputs may be based on a magnitude of an applied signal. Appreciating that the magnitude of the stimulus may be binary in some embodiments (i.e., on or off), the relationship may be modeled as $z_n=f_n(s_n)$, where $s_n$ is the real-valued magnitude of the stimulus. The function $f_n(s_n)$ can be fitted with a polynomial order S, and substituted into $|S_{1N}|^2$. The functions $f_n$ can be all the same when identical dynamically tunable elements are used, in which case there will be N extremum conditions for N real variables $s_n$, each of which is still a rational function.

In the lowest-order approximation, the fitting polynomial can be linear (S=1), in which case the complexity of the extremum problem is still $$\frac{\partial |S_{1N}|^2}{\delta \chi_n} = 0, n = 1, \ldots, N.$$

The quality of a polynomial approximation depends greatly on the practically available range of the stimulus, or the range chosen for other practical considerations. Because the $s_n$ variables are restricted to a finite interval, the optimization problem can be solved with the corresponding constraints. When the optimization problem is solved by exhaustive enumeration of the extrema, these constrains are applied trivially and the local extrema not satisfying the constraints are excluded from the enumeration.

A wide range of coding applications are contemplated and made possible using the systems and methods described herein. For example, the lumped impedance element approach may be used to implement the antenna systems 100, 400, 500, and other antenna systems discussed above, and the method 700 discussed above. In some embodiments, beamforming may include a multipath propagation channel involving one or more reflective, refractive, or generally scattering objects. In many embodiments, the relevant properties of the multipath propagation channel are incorporated into the Z-matrix. Numerical simulations that lead to a calculation of the Z-matrix may include a model of such a channel. A model of the multipath propagation channel can be simulated using any of a wide variety of simulation software packages, including, for example, ANSYS HFSS, COMSOL RF, CST MWS, etc.

In some embodiments, a particular linear field polarization can be achieved by considering the output port to be a port susceptible to only one linear polarization. For instance, a lumped (electrically small, single-mode) port is susceptible to a linear polarization with the electric field directed across the gap of the port.

In some embodiments, a target radiation pattern may be identified that includes a combination of two linear polarizations, including without limitation a circular polarization, that can be achieved by considering two co-located output ports, each of which is susceptible to only one linear polarization. In such an embodiment, the system matrices may be slightly increased by the addition of more external ports, $N_e$, but the addition of a few external ports increases the complexity by a relatively small constant value and will not change the general course of the algorithms and methods described herein.

In some embodiments, multiple beams can be formed simultaneously (the process known as multi-beam forming) by considering M output ports located in different directions with respect to the rest of the system. The size of the system matrices may then correspond to N=Na+M+1, which does not change the general course of the algorithm and does not exponentially increase the complexity.

As previously discussed, approximate nulls of the field can be formed, either in the far-field or near-field, by considering a minimization problem for the rational function of the equations above. Similarly, a required level of sidelobe suppression for a target radiation pattern can be attained by maximizing the function $F=|S_{1N}|^2-\alpha|S_{1,N+1}|^2$, where the $N^{th}$ port measures the field intensity in one direction, the $(N+1)^{th}$ port measures field intensity in a specified sidelobe direction, and $\alpha$ is a selectable weight coefficient reflecting the degree to which sidelobe suppression should be achieved. It is appreciated that the equation above can be readily generalized to include any number of sidelobes in any number of directions. Thus, it is appreciated that instead of optimizing the impedance values themselves, a function relating the impedance control inputs to the impedance values of the variable (i.e., tunable) impedance elements may be substituted into the equations to allow for the direct optimization of the impedance control inputs.

As noted above, the impedance of the lumped impedance element may be frequency dependent. Thus, the lumped impedance element may have first impedance at the base or selected frequency, a second impedance at the first harmonic frequency, a second impedance at the second harmonic frequency, and so forth. A transmission of EM radiation may result in one or more harmonic frequencies being formed at the receiver. The amount of power that goes into these higher harmonic frequencies is not insignificant. For example, the up to 50% of the EM radiation power may be contained in the first and second harmonic frequencies. Accordingly, the described systems and methods take these into consideration in the optimization problem. Since the S-matrix is dependent on the impedance values of the lumped impedance elements and the impedance values may be different for each higher harmonic frequency, the described S-matrix computation may be determined for each of a plurality of harmonic frequencies. For example, an S-matrix is determined for the selected frequency (e.g., the fundamental or base frequency), an S-matrix is determined for the first harmonic frequency, an S-matrix is determined for the second harmonic frequency, and so forth. The controller (e.g., controller 112 from FIG. 1) may consider each of the determined S-matrices when determining the desired S-matrix. In this way, the desired S-matrix may be optimized for capturing the power contained in both the fundamental frequency and the higher harmonic frequencies. As discussed above, the optimized impedance vector $\{z_n\}$ may be determined based on the desired S-matrix.

As discussed herein, the lumped external impedance ports, $N_e$, are selected to include one or more values related to the DC portion of the rectenna. For example, the lumped external impedance ports, $N_e$, may be selected to include one or more inputs of the rectifier circuitry, one or more outputs of the rectifier circuitry, one or more inputs of the combiner circuitry, and/or one or more outputs of the combiner circuitry. The inclusion of one or more values related to the DC portion of the rectenna may allow for the S-matrix to be optimized for the DC portion of the rectenna. For example, optimizing the S-matrix for maximizing the combined output current at the output of the combining circuitry allows the S-matrix to optimize both the RF portion and the DC portion of the rectenna.

Although not shown, each of the rectifier circuitry and/or the combining circuitry (such as rectifier circuitry 114 and DC combining circuitry 116 in FIG. 1) may include tunable components. In addition to determining optimized impedance values for the lumped impedance elements (e.g., lumped impedance elements 202), optimized tuning values may also be determined for each of the tunable resistance values for the components in the rectifier circuitry and/or the combining circuitry. As noted above, the resistance of the DC portion of the rectenna impacts the antenna aperture efficiency of the RF portion of the rectenna. This S-matrix approach is flexible enough to account for both the complex mutual coupling of the subwavelength antenna elements as well as the complex interaction between the RF portion and the DC portions of the rectenna. Accordingly, the S-matrix approach as discussed herein may allow for the rectenna to be optimized as a whole.

Figure 6:
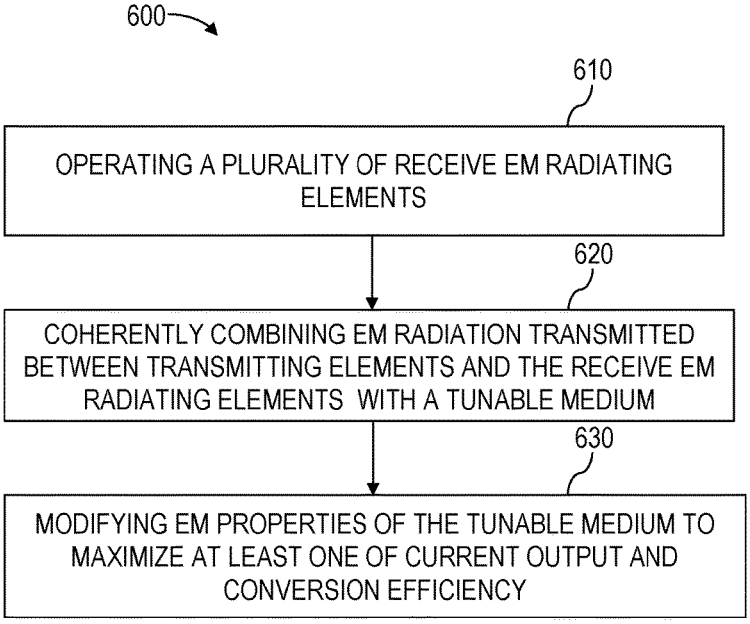
FIG. 6 is a simplified flow chart illustrating a method 600 of operating an antenna system.

FIG. 6 is a simplified flow chart illustrating a method 600 of operating an antenna system, such as the rectenna 100 illustrated in FIG. 1. Referring to FIGS. 1 and 6 together, the method 600 includes operating 610 receive EM radiating elements 102. In some embodiments, operating 610 receive EM radiating elements 102 includes receiving EM radiation 106 in the receive EM radiating elements 102, and delivering the EM radiation 106 to rectifier circuitry which transforms the EM radiation 106 into direct current outputs (which may be combined into a combined output by combiner circuitry, for example). In some embodiments, operating 610 receive EM radiating elements 102 includes receiving EM signals including a plurality of different power streams from the transmitting elements 104 through the receive EM radiating elements 102.

The method 600 also includes coherently combining 620 (e.g., scattering) the EM radiation 106 transmitted between the transmitting elements 104 and the receive EM radiating elements 102 with a tunable medium 200.

The method 600 further includes modifying 630 EM properties of the tunable medium 200 to modify the EM radiation 106 transmitted between the transmitting elements 104 and the receive EM radiating elements 102. In some embodiments, modifying 630 EM properties of the tunable medium 200 includes dynamically modifying the EM properties of the tunable medium 200 during operation of the antenna system 100 to maximize a current output at a combined output. In some embodiments, modifying 630 EM properties of the tunable medium 200 includes dynamically modifying the EM properties of the tunable medium 200 during operation of the antenna system 100 to maximize a conversion efficiency of the EM power to direct current power. In some embodiments, modifying 630 EM properties of the tunable medium 200 includes pre-selecting a state of the tunable medium 200 and holding the tunable medium 200 in the selected state during operation of the antenna system 100.

Figure 7:
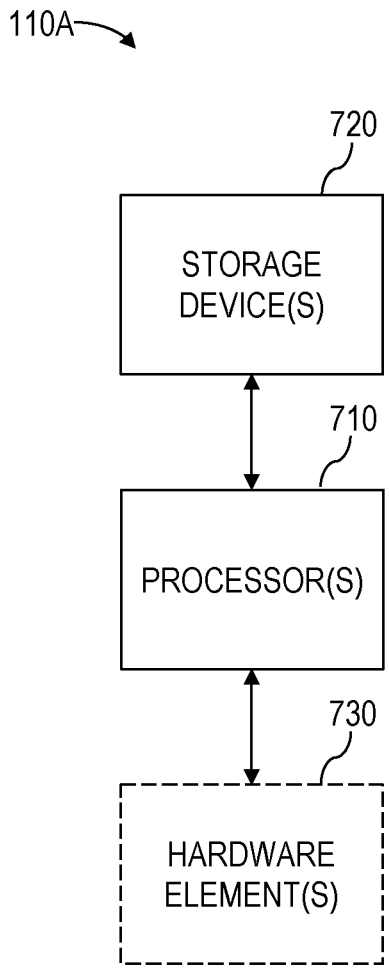
FIG. 7 is a simplified block diagram of example control circuitry of the antenna system of FIG. 1.

FIG. 7 is a simplified block diagram of example control circuitry 110A (hereinafter "control circuitry" 110A) of control circuitry 110 of the antenna system 100 of FIG. 1. The control circuitry 110A may include at least one processor 710 (hereinafter referred to simply as "processor" 710) operably coupled to at least one data storage device 720 (hereinafter referred to simply as "storage" 720). The storage 720 may include at least one non-transitory computer-readable medium. By way of non-limiting example, the storage 720 may include one or more volatile data storage devices (e.g., Random Access Memory (RAM)), one or more non-volatile data storage devices (e.g., Flash, Electrically Programmable Read Only Memory (EPROM), a hard drive, a solid state drive, magnetic discs, optical discs, etc.), other data storage devices, and combinations thereof.

The storage 720 may also include data corresponding to computer-readable instructions stored thereon. The computer-readable instructions may be configured to instruct the processor 710 to execute at least a portion of the functions that the control circuitry 110 (FIG. 1) is configured to perform. By way of non-limiting example, the computer-readable instructions may be configured to instruct the processor 710 to execute at least a portion of the functions of at least one of the rectifier circuitry 114, the DC combining circuitry 116, and the controller 112 (e.g., at least a portion of the functions discussed with reference to the method 700 of FIG. 7) of FIG. 1. Also by way of non-limiting example, the computer-readable instructions may be configured to instruct the processor 710 to execute at least a portion of the functions of at least one of the receive control circuitry 410 (FIG. 4), the transmit control circuitry 420 (FIG. 4), the receive control circuitry 510 (FIG. 5), and the transmit control circuitry 520 (FIG. 5).

The processor 710 may include a Central Processing Unit (CPU), a microcontroller, a Programmable Logic Controller (PLC), other programmable device, or combinations thereof. The processor 710 may be configured to execute the computer-readable instructions stored by the storage 720. By way of non-limiting example, the processor 710 may be configured to transfer the computer-readable instructions from non-volatile storage of the storage 720 to volatile storage of the storage 720 for execution. Also, in some embodiments, the processor 710 and at least a portion of the storage 720 may be integrated together into a single package (e.g., a microcontroller including internal storage, etc.). In some embodiments, the processor 710 and the storage 720 may be implemented in separate packages.

In some embodiments, the control circuitry 110A may also include at least one hardware element 730 (hereinafter referred to simply as "hardware element" 730). The hardware element 730 may be configured to perform at least a portion of the functions the control circuitry 110A is configured to perform. By way of non-limiting example, the hardware element 730 may be configured to perform at least a portion of the functions of at least one of the rectifier circuitry 114, the DC combining circuitry 116, and the controller 112 (e.g., at least a portion of the functions discussed with reference to the method 700 of FIG. 7) of FIG. 1. Also by way of non-limiting example, the hardware element 730 may be configured to instruct the processor 710 to execute at least a portion of the functions of at least one of the receive control circuitry 410 (FIG. 4), the transmit control circuitry 420 (FIG. 4), the receive control circuitry 510 (FIG. 5), and the transmit control circuitry 520 (FIG. 5). In some embodiments, the hardware element 730 may include a System on Chip (SOC), an array of logic circuits configured to be programmably interfaced to perform functions of the control circuitry 110A (e.g., a Field Programmable Gate Array (FPGA)), an Application Specific Integrated Circuit (ASIC), other hardware elements, and combinations thereof.

Figure 8:
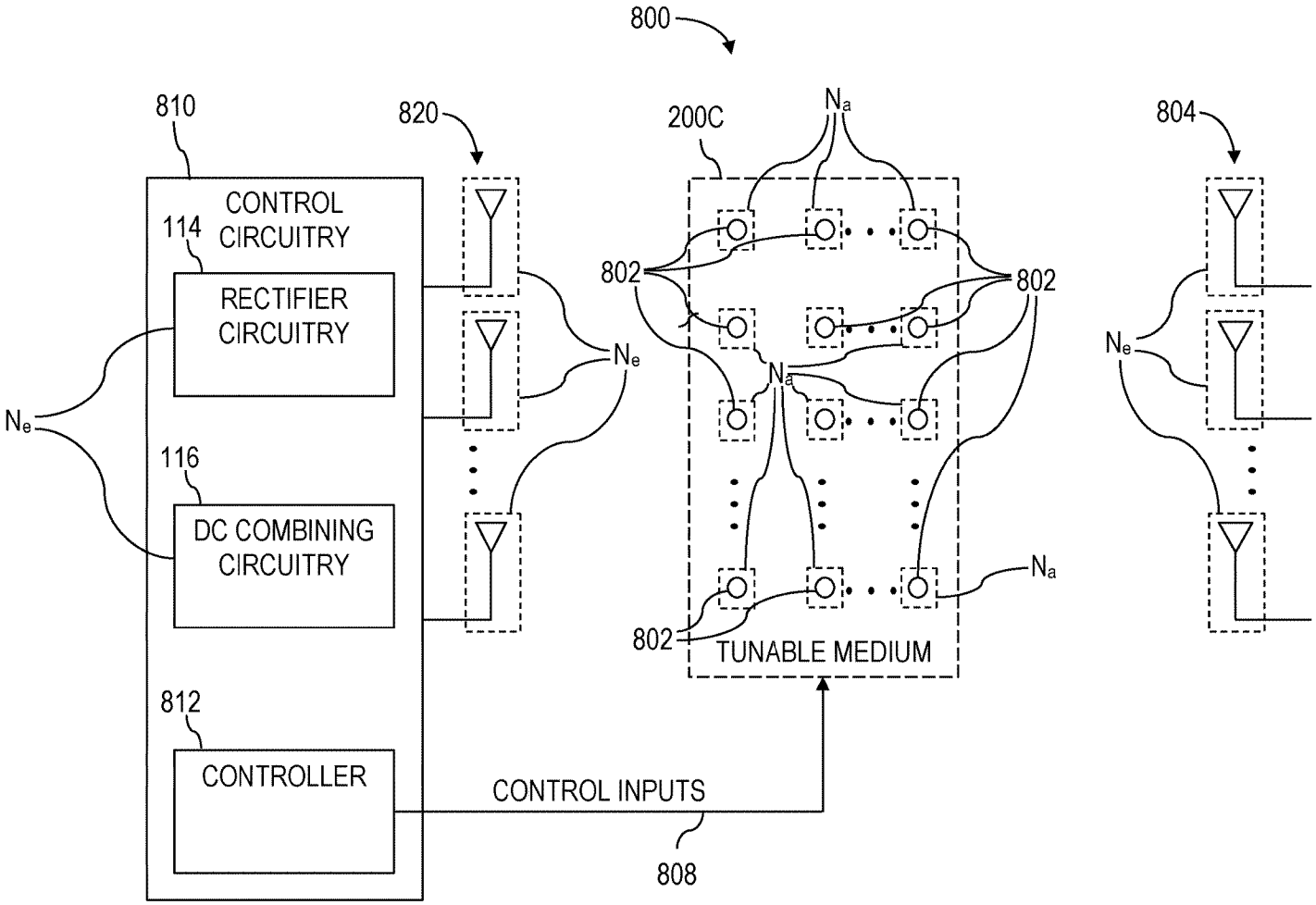
FIG. 8 is a simplified block diagram of an antenna system, according to some embodiments.

FIG. 8 is a simplified block diagram of an antenna system 800, according to some embodiments. The antenna system 800 includes the near-end EM radiating elements 802 (e.g., subwavelength antenna elements 102) and the far-end EM radiating elements (e.g., transmitting elements 104) discussed above with respect to the rectenna 100 of FIG. 1. The antenna system 800 also includes a tunable medium 200C similar to the tunable medium 200 of FIG. 1. The antenna system 800 further includes control circuitry 810 that is similar to the control circuitry 110 of FIG. 1 (e.g., the control circuitry 810 includes the rectifier circuitry 114 and the DC combining circuitry 116 of the control circuitry 110 of FIG. 1). The control circuitry 810, however, includes a controller 812. Similar to the controller 112 of FIG. 1, the controller 812 is configured to control the tunable medium 200C (via the control inputs 808, for example) to function as a linear decoder or coherent power combiner (when the near-end EM radiating elements 102 are receiving), as discussed above. The controller 812, however, is configured to control the tunable medium 200C in terms of modeled lumped ports.

In the example of FIG. 8, the controller 812 is configured to associate a plurality of tunable EM radiating elements 802 of the tunable medium 200C with a plurality of internal lumped ports $N_a$. The controller 812 is also configured to associate the inputs 820 and/or outputs (not shown) of the rectifier circuitry 114, the combined output (not shown) of the DC combining circuitry 116, and/or the far-end EM radiating elements as lumped external ports $N_e$. Accordingly, the controller 812 is configured to identify lumped ports N including both the internal lumped ports $N_a$ and the lumped external ports $N_e$.

The controller 812 is configured to determine an S-matrix relating field amplitudes and field related values (e.g., current output, combined output, etc.) at the lumped ports N. The controller 812 is also configured to determine at least a portion of component values of a desired S-matrix relating the field amplitudes at the lumped ports N. The controller 812 is further configured to modify control inputs 808 configured to tune the tunable EM radiating elements 802 to implement the desired S-matrix.

The controller 812 is configured to analyze the S-matrix and the desired S-matrix in terms of their static and dynamic components. By way of non-limiting example, the controller 812 may be configured to determine the S-matrix as a function of an impedance matrix (Z-matrix) and an admittance vector (y-vector). The Z-matrix includes impedance values relating voltage potentials at each of the lumped ports N to currents at each of the lumped ports N with all others of the lumped ports open at an operational frequency of the antenna system 800. The y-vector is a diagonal matrix including impedance values of the lumped ports N. The Z-matrix represents the static components of the S-matrix, and the y-vector represents the dynamic components of the S-matrix.

Also by way of non-limiting example, the controller 812 may be configured to determine the S-matrix as a function of an admittance matrix (Y-matrix) and an impedance vector (z-vector). The Y-matrix includes admittance values relating voltage potentials at each of the lumped ports N to currents at each of the lumped ports N with all others of the lumped ports open at an operational frequency of the antenna system 800. The z-vector is a diagonal matrix including impedance values of the lumped ports N. The Y-matrix represents the static components of the S-matrix, and the z-vector represents the dynamic components of the S-matrix.

The S-matrix (and the desired S-matrix) may, then, be expressed as a function of the Z-matrix and the y-vector, or equivalently as a function of the Y-matrix and the z-vector, as follows:

$$S=(\sqrt{y}Z\sqrt{y}-1)(\sqrt{y}Z\sqrt{y}+1)^{-1}=(1-\sqrt{z}Y\sqrt{z})(1+\sqrt{z}Y\sqrt{z})^{-1}$$

Since the Z-matrix and the Y-matrix represent static components of the S-matrix, the components of these matrices do not change as the impedance of the tunable EM radiating elements 802 is modified by the control inputs 808 from the controller 812. The z-vector and the y-vector, however, do change as the impedance of the tunable EM radiating elements 802 is modified. Accordingly, as the controller 812 computes an S-matrix or a desired S-matrix, only the z-vector or y-vector need be accounted for once the Z-matrix or the Y-matrix has been established, reducing complexity computations subsequent to a first determination of the S-matrix or desired S-matrix.

More specifically, as the z-vector and the y-vector have only $N_e+N_a$ components that can be non-zero, optimization calculations scale relatively linearly with the number of degrees of freedom. By contrast, if the static portions of the S-matrix or desired S-matrix are instead simulated or computed for each iteration of the optimization calculation, the complexity of the calculations scales as N×N, which is more computationally expensive. As a result, resources may be conserved by taking the lumped ports approach disclosed herein. Also, the lumped ports approach disclosed herein may be more suitable for real-time adjustments of the tunable medium 200C.

Figure 9:
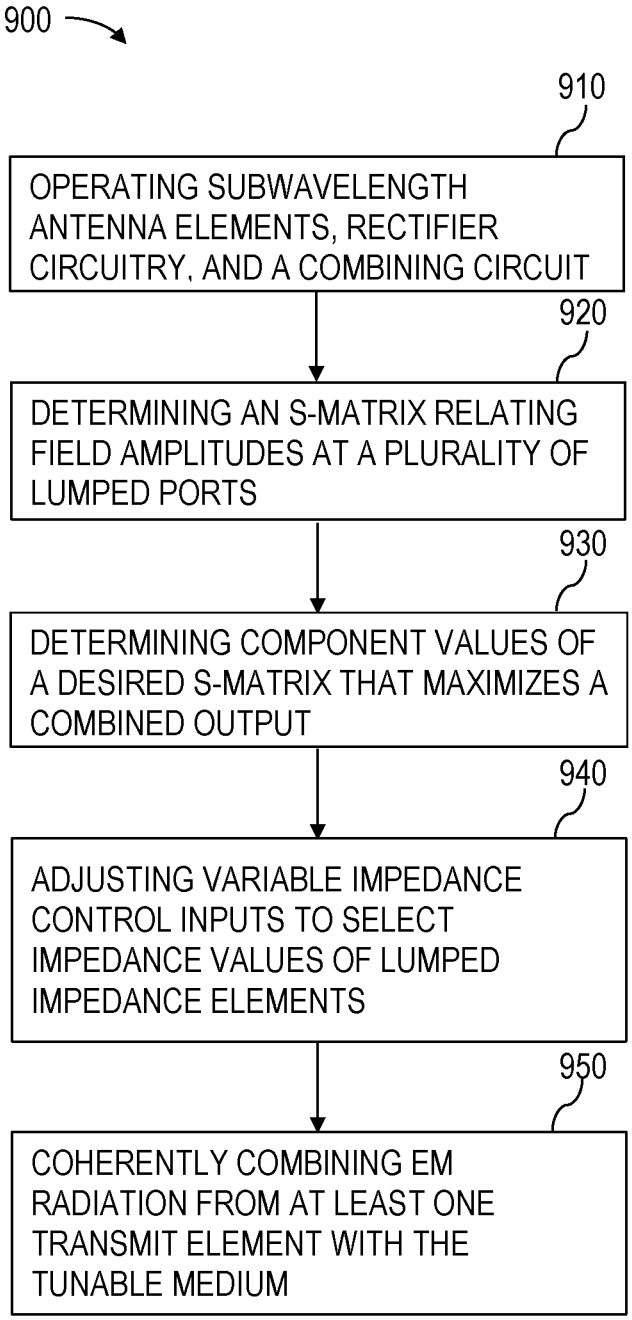
FIG. 9 is a simplified flowchart illustrating a method of operating an antenna system, according to some embodiments.

FIG. 9 is a simplified flowchart illustrating a method 900 of operating an antenna system (e.g., the antenna system 100, 400, 500, 800), according to some embodiments. By way of non-limiting example, the method 900 may be implemented, at least in part, by the control circuitry 110A of FIG. 7. Referring to FIGS. 8 and 9 together, the method 900 includes operating 910 a plurality of subwavelength antenna elements 102, rectifier circuitry 114, and DC combining circuitry 116. In some embodiments, operating 910 a plurality of subwavelength antenna elements 102 includes operating the plurality of subwavelength antenna elements 102 as receiving antennas.

The method 900 also includes determining 920 an S-matrix relating field amplitudes at a plurality of lumped ports, including internal lumped ports $N_a$ and lumped external ports $N_e$. The internal lumped ports $N_a$ are located internally to the tunable medium (e.g., on or in the tunable medium 200C). Each of the internal lumped ports $N_a$ corresponds to a different one of lumped impedance elements associated with subwavelength antenna elements 102 of a tunable medium 200C. The tunable medium 200C is positioned relative to the plurality of rectifier circuitry 114 to coherently combine EM radiation 106 transmitted between the at least one transmitting element 104 and the subwavelength antenna elements 102. The lumped external ports $N_e$ are located externally to the tunable medium 200C. Each of at least a portion of the lumped external ports $N_e$ corresponds to a different one of the plurality of inputs to the rectifier circuitry, the combined output of the combining circuitry, and the at least one far-end transmitting element 104.

The method 900 further includes determining 930 at least a portion of component values of a desired S-matrix relating the field amplitudes at the lumped ports. In some embodiments, determining 930 at least a portion of component values of a desired S-matrix includes determining the S-matrix as a function of a Z-matrix and a y-vector. In some embodiments, determining 930 at least a portion of component values of a desired S-matrix includes determining the S-matrix as a function of a Y-matrix and a z-vector. In some embodiments, determining 930 at least a portion of component values of a desired S-matrix includes determining an optimized port impedance vector $\{z_n\}$ of impedance values, $z_n$, for each of the internal lumped ports that result in an S-matrix element for the lumped external ports that maximizes the combined output at the combining circuit for a base frequency. In some cases, maximizing the combined output includes maximizing a total current output. Additionally or alternatively, maximizing the combined output includes maximizing a conversion efficiency between incident EM radiation at a base frequency and a combined output current.

The method 900 also includes adjusting 940 at least one variable impedance control input configured to enable selection of an impedance value for each of the lumped impedance elements. Adjusting 940 includes modifying the impedance value of at least one of the lumped impedance elements to cause the S-matrix to modify to at least approximate at least a portion of the desired S-matrix.

The method 900 further includes coherently combining 950 the EM radiation transmitted between the at least one transmitting element 104 and the plurality of subwavelength antenna elements 102 with the tunable medium 200C. In some embodiments, coherently combining 950 the EM radiation includes decoding (e.g., coherent combiner) the EM radiation as one of a linear beamforming decoder, a linear spatial-diversity decoder, or a linear spatial multiplexing decoder.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined to include the following claims.

What is claimed is:

1. An antenna system, comprising:

a plurality of antenna elements that are spaced at subwavelength intervals relative to a base frequency within a base frequency range;

a plurality of lumped impedance elements, where at least a portion of the plurality of lumped impedance elements are associated with the plurality of antenna elements;

a plurality of impedance control inputs configured to allow for a selection of an impedance value for each of the plurality of lumped impedance elements;

a plurality of rectification circuits in communication with the plurality of antenna elements, each of the plurality of rectification circuits for generating an output current;

a combining direct current (DC) circuit for combining one or more generated output currents together into a combined output;

a computer-readable medium with instructions that when executed by a processor cause the processor to:

determine a scattering matrix (S-matrix) of electromagnetic field amplitudes at a select frequency for each of a plurality of lumped ports, N, wherein the plurality of lumped ports, N, include:

a plurality of lumped antenna ports, $N_a$, with impedance values corresponding to the impedance values for each of the plurality of lumped impedance elements; and at least one lumped external port, $N_e$, located physically external to the antenna system, wherein the S-matrix is expressible in terms of an impedance matrix, Z-matrix, with impedance values, $z_n$, of each of the plurality of lumped ports, N;

determine an optimized port impedance vector $\{z_n\}$ of impedance values, $z_n$, for each of the lumped antenna ports, $N_a$, that result in an S-matrix element for the at least one lumped external port, $N_e$, that maximizes the combined output at the combining DC circuit; and adjust at least one of the plurality of impedance control inputs to modify at least one of the plurality of lumped impedance elements based on the determined optimized $\{z_n\}$ of the impedance values for the lumped antenna ports, $N_a$.

2. The antenna system of claim 1, wherein a base frequency is a center frequency of a substantially continuous-wave source.

3. The antenna system of claim 1, wherein a base frequency is the center frequency of a narrow-band modulated signal.

4. The antenna system of claim 1, wherein a base frequency is the frequency of the peak spectral power density of a modulated signal.

5. The antenna system of claim 1, wherein the select frequency is associated with a base frequency and at least one other frequency.

6. The antenna system of claim 5, wherein the instructions to determine a scattering matrix (S-matrix) of electromagnetic field amplitudes for each of a plurality of lumped ports, N, comprise instructions that when executed by the processor cause the processor to:

determine an S-matrix at the base harmonic frequency and at each of the at least one higher harmonic frequency.

7. The antenna system of claim 6, wherein the instructions to determine an optimized port impedance vector $\{z_n\}$ of impedance values, $z_n$, for each of the tunable impedance elements represented by lumped ports, $N_a$, that result in an S-matrix element for the at least one lumped external port, $N_e$, that maximizes the combined output current at the combining DC circuit for the select frequency, comprise instructions that, when executed by the processor, cause the processor to:

determine an optimized port impedance vector $\{z_n\}$ of impedance values, $z_n$, for each of the tunable impedance elements represented by lumped ports, $N_a$, that result in an S-matrix element for the at least one lumped external port, $N_e$, that maximizes the combined output current at the combining DC circuit for the base harmonic frequency and that maximizes the combined output current at the combining DC circuit for each of the at least one higher frequency.

8. The antenna system of claim 1, wherein at least one of the plurality of impedance control inputs is adjusted to maximize a conversion efficiency between a radio frequency signal and the combined output.

9. The antenna system of claim 1, wherein at least one of the plurality of impedance control inputs is adjusted to maximize a total output current at the combined output.

10. The antenna system of claim 1, wherein each rectification circuit comprises one or more rectifier tunable elements.

11. The antenna system of claim 10, further comprising a plurality of rectification control inputs configured to allow for tuning of each of the one or more rectifier tunable elements.

12. The antenna system of claim 11, wherein each rectifier tunable element is selected from the group consisting of: a variable resistor; a variable capacitor; a variable inductor; a transistor; a varactor diode; and a voltage-controlled non-linear element.

13. The antenna system of claim 11, wherein the instructions are further executable by the processor to:

adjust at least one of the plurality of rectifier control inputs together with the adjusting the at least one of the plurality of impedance control inputs to balance the impedance value for each of one or more lumped impedance elements with a resistance value of the rectification circuit.

14. The antenna system of claim 10, wherein at least one of the one or more rectifier tunable elements attenuates a received radio frequency signal at a respective rectification circuit.

15. The antenna system of claim 14, wherein each rectifier tunable element is selected from the group consisting of: a variable resistor; a transistor; an attenuator; a voltage-controlled non-linear element; and a varactor diode.

16. The antenna system of claim 10, wherein the instructions are further executable by the processor to adjust at least one of the plurality of rectifier control inputs together with the adjusting the at least one of the plurality of impedance control inputs to maximize the combined output.

17. The antenna system of claim 10, wherein the instructions are further executable by the processor to adjust at least one of the plurality of rectifier control inputs together with the adjusting the at least one of the plurality of impedance control inputs to maximize a conversion efficiency between a radio frequency signal and the combined output.

18. The antenna system of claim 1, wherein at least some of the plurality of antenna elements comprise resonating elements.

19. The antenna system of claim 1, wherein at least two of the plurality of antenna elements comprise a metamaterial.

20. The antenna system of claim 1, wherein the at least one lumped external port, $N_e$, comprises a virtual external port.

21. The antenna system of claim 1, wherein a variable impedance control input associated with at least one of the lumped impedance elements can be varied to adjust the impedance value of the at least one lumped impedance element, wherein the variable impedance control input comprises one of: an electrical current input, a radiofrequency electromagnetic wave input, an optical radiation input, a thermal radiation input, a terahertz radiation input, an acoustic wave input, a phonon wave input, a thermal conduction input, a mechanical pressure input and a mechanical contact input.

22. The antenna system of claim 1, wherein the impedance value of at least one of the lumped impedance elements is variable based on one or more electrical impedance control inputs.

23. The antenna system of claim 1, wherein the impedance value of at least one of the lumped impedance elements is variable based on one or more mechanical impedance control inputs.

24. A method of operating a rectenna, the method comprising:

operating a plurality of subwavelength antenna elements in a tunable medium;

operating a plurality of rectifier circuits;

operating a combining circuit that combines outputs of at least one of the plurality of rectifier circuits into a combined output;

determining a scattering matrix (S-matrix) relating field amplitudes at a plurality of lumped ports, N, wherein the plurality of lumped ports, N, include:

internal lumped ports located internally to the tunable medium, each of the internal lumped ports corresponding to a different one of lumped impedance elements associated with a subwavelength antenna element of the plurality of subwavelength antenna elements; and lumped external ports located externally to the tunable medium, each of at least a portion of the lumped external ports corresponding to at least one of the combined output and at least one transmitting element, wherein the S-matrix is expressible in terms of an impedance matrix, Z-matrix, with impedance values, $z_n$, of each of the plurality of lumped ports, N;

determining an optimized port impedance vector $\{z_n\}$ of impedance values, $z_n$, for each of the internal lumped ports that result in an S-matrix element for the lumped external ports that maximizes the combined output at the combining circuit for a base frequency;

determining at least a portion of component values of a desired S-matrix relating the field amplitudes at the lumped ports;

adjusting at least one variable impedance control input configured to enable selection of an impedance value for each of the lumped impedance elements, wherein adjusting includes modifying the impedance value of at least one of the lumped impedance elements to cause the S-matrix to modify to at least approximate at least a portion of the desired S-matrix; and coherently combining electromagnetic (EM) radiation transmitted between the at least one transmitting element and the plurality of subwavelength antenna elements with the tunable medium.

25. The method of claim 24, wherein the plurality of subwavelength antenna elements is coupled to the plurality of rectification circuits via evanescent coupling.

26. The method of claim 24, wherein the plurality of subwavelength antenna elements is coupled to the plurality of rectification circuits in a plurality-to-one arrangement.

27. The method of claim 24, wherein the base frequency is associated with a first harmonic frequency and at least one higher harmonic frequency.

28. The method of claim 27, wherein determining a scattering matrix (S-matrix) relating field amplitudes at a plurality of lumped ports, N, comprises determining an S-matrix at the base frequency and at each of the at least one higher harmonic frequency.

29. The method of claim 28, wherein determining an optimized port impedance vector $\{z_n\}$ of impedance values, $z_n$, for each of the internal lumped ports that result in an S-matrix element for the lumped external ports that maximizes the combined output at the combining circuit for a select frequency comprises determining an optimized port impedance vector $\{z_n\}$ of impedance values, $z_n$, for each of the internal lumped ports that result in an S-matrix element for the lumped external ports that maximizes the combined output at the combining circuit for the base frequency and that maximizes the combined output at the combining circuit for each of the at least one higher harmonic frequency.

30. The method of claim 24, wherein each rectifier circuit comprises one or more variable resistance control inputs for tuning the rectifier circuit.

31. The method of claim 30, further comprising adjusting at least one variable resistance control input together with the adjusting the at least one variable impedance control input to maximize the combined output at the combining circuit.

32. An antenna system, comprising:

a plurality of antenna elements that are spaced at sub-wavelength intervals relative to a base frequency that is associated with a first frequency and at least one higher harmonic frequency;

a plurality of lumped impedance elements, where at least a portion of the plurality of lumped impedance elements are associated with the plurality of antenna elements;

a plurality of control inputs configured to allow for a selection of an impedance state for each of the plurality of lumped impedance elements, wherein the impedance state refers to a set of frequency-dependent impedance values;

a plurality of rectification circuits in communication with the plurality of antenna elements, each of the plurality of rectification circuits for generating an output current;

a combining direct current (DC) circuit for combining at least one generated output current together into a combined output;

a computer-readable medium providing instructions that when executed by a processor cause the processor to:

determine a scattering matrix (S-matrix) of electromagnetic field amplitudes at a select frequency and at the at least one higher harmonic frequency, for each of a plurality of lumped ports, N, wherein the plurality of lumped ports, N, include:

a plurality of lumped antenna ports, $N_a$, with impedance values corresponding to the impedance state for each of the plurality of lumped impedance elements at each of the corresponding frequencies; and at least one lumped external port, $N_e$, located physically external to the antenna system, wherein the S-matrix is expressible in terms of an impedance matrix, Z-matrix, with impedance values, $z_n$, of each of the plurality of lumped ports, N, at each of the corresponding frequencies;

determine an optimized port impedance vector $\{z_n\}$ of impedance values, $z_n$, for each of the lumped antenna ports, $N_a$, that result in an S-matrix element for the at least one lumped external port, $N_e$, that maximizes the combined output at the combining DC circuit; and adjust at least one of the plurality of control inputs to modify at least one of the plurality of lumped impedance elements based on the determined optimized $\{z_n\}$ of the impedance values for the lumped antenna ports, $N_a$.

33. The antenna system of claim 32, wherein the plurality of antenna elements is coupled to the plurality of rectification circuits via a direct electrical connection.

34. The antenna system of claim 32, wherein the select frequency is associated with a base frequency and at least one other frequency.

35. The antenna system of claim 34, wherein the at least one other frequency comprises an integer harmonic of the base frequency.

36. The antenna system of claim 32, wherein the plurality of antenna elements is coupled to the plurality of rectification circuits via evanescent coupling.

37. The antenna system of claim 32, wherein the plurality of antenna elements is coupled to the plurality of rectification circuits in a one-to-one arrangement.

38. The antenna system of claim 32, wherein the plurality of antenna elements is coupled to the plurality of rectification circuits in a plurality-to-one arrangement.

39. The antenna system of claim 32, wherein the plurality of antenna elements is at least partially overlapping with the plurality of rectification circuits.

40. The antenna system of claim 32, wherein the combining DC circuit combines the one or more generated output currents together into the combined output by summing over the one or more generated output currents.

* * * * *